US010411353B2

(12) United States Patent
Sugita et al.

(10) Patent No.: US 10,411,353 B2
(45) Date of Patent: Sep. 10, 2019

(54) TRANSPARENT ANTENNA AND TRANSPARENT ANTENNA-EQUIPPED DISPLAY DEVICE

(71) Applicant: Sharp Kabushiki Kaisha, Sakai, Osaka (JP)

(72) Inventors: Yasuhiro Sugita, Sakai (JP); Tomohiro Kimura, Sakai (JP); Yuhji Yashiro, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/536,093

(22) PCT Filed: Dec. 15, 2015

(86) PCT No.: PCT/JP2015/085039
§ 371 (c)(1),
(2) Date: Jun. 14, 2017

(87) PCT Pub. No.: WO2016/098761
PCT Pub. Date: Jun. 23, 2016

(65) Prior Publication Data

US 2017/0352959 A1 Dec. 7, 2017

(30) Foreign Application Priority Data

Dec. 18, 2014 (JP) ..... 2014-256437

(51) Int. Cl.

| | |
|---|---|
| ***H01Q 1/22*** | (2006.01) |
| ***H01Q 9/04*** | (2006.01) |
| ***H01Q 1/24*** | (2006.01) |
| ***H01Q 1/38*** | (2006.01) |
| ***H01Q 1/44*** | (2006.01) |

(52) U.S. Cl.
CPC ..... *H01Q 9/0407* (2013.01); *H01Q 1/22* (2013.01); *H01Q 1/2266* (2013.01); *H01Q 1/24* (2013.01); *H01Q 1/38* (2013.01); *H01Q 1/44* (2013.01)

(58) Field of Classification Search
CPC .... H01Q 1/22–2266; H01Q 7/00; G06K 7/10; G06K 19/07–077
See application file for complete search history.

(56) References Cited

U.S. PATENT DOCUMENTS 7,079,079 B2 * 7/2006 Jo ..... H01Q 1/243 343/700 MS
9,608,327 B1 * 3/2017 Tai ..... H01Q 7/06
(Continued)

FOREIGN PATENT DOCUMENTS

| | | |
|---|---|---|
| JP | 2005-142984 A | 6/2005 |
| JP | 2013-5013 A | 1/2013 |
| JP | 2014-501465 A | 1/2014 |

*Primary Examiner* — Dameon E Levi
*Assistant Examiner* — Hasan Z Islam
(74) *Attorney, Agent, or Firm* — ScienBiziP, P.C.

(57) ABSTRACT

Included is an antenna wire 21, formed by a reticulated metal film in a shape of a ring, which generates a magnetic field on a center side thereof. The antenna wire 21 has a first extension part 23 extending along a direction of extension of the antenna wire 21 and a second extension part 24 extending along a direction intersecting with the direction of extension. The antenna wire 21 is configured such that a per unit length area of the first extension part 23 is larger than a per unit length area of the second extension part 24.

20 Claims, 28 Drawing Sheets

(56) References Cited

U.S. PATENT DOCUMENTS

2009/0051620 A1* 2/2009 Ishibashi ..... H01Q 1/243
343/897
2013/0264390 A1* 10/2013 Frey ..... H01Q 1/2225
235/492

* cited by examiner

TRANSPARENT ANTENNA AND TRANSPARENT ANTENNA-EQUIPPED DISPLAY DEVICE

TECHNICAL FIELD

The present invention relates to a transparent antenna and a transparent antenna-equipped display device.

BACKGROUND ART

A known example of a transparent antenna that is attached to a screen of a display to perform communication with an external device or the like is described in PTL 1 listed below. PTL 1 describes a transparent antenna including: a transparent substrate; and an antenna pattern formed on at least one surface of the transparent substrate, wherein the antenna pattern is formed by a conductor mesh layer obtained by forming an opaque conductor layer in a mesh pattern, and the mesh pattern is constituted by a large number of boundary segments defining a large number of opening regions and includes a region comprising patterns in which the average N of the numbers of boundary segments that extend from one branch point is $3.0 \leq N < 4.0$ and there is no direction in which the opening regions have repetition frequency.

CITATION LIST

Patent Literature

PTL 1: Japanese Unexamined Patent Application Publication No. 2013-5013

Technical Problem

PTL 1 states that the antenna pattern of the transparent antenna is formed by the conductor mesh layer. Note here that while increased light transmittance of the transparent antenna can be achieved simply by expanding the opening regions of the conductor mesh layer, doing so undesirably invites an increase in wiring resistance and, by extension, a decrease in antenna performance. On the other hand, while improved antenna performance of the transparent antenna can be achieved simply by widening the boundary segments defining the opening regions of the conductor mesh layer, doing so undesirably invites a reduction in size of the opening regions and, by extension, a decrease in light transmittance. Thus, the transparent antenna including the conductor mesh layer has suffered from a trade-off between light transmittance and wiring resistance.

SUMMARY OF INVENTION

The present invention is one achieved in view of such circumstances and has as an object to achieve a reduction in wiring resistance while achieving sufficient light transmittance.

Solution to Problem

A first transparent antenna of the present invention includes an antenna wire, formed by a reticulated metal film in a shape of a ring, which generates a magnetic field on a center side thereof. The antenna wire has a first extension part extending along a direction of extension of the antenna wire and a second extension part extending along a direction intersecting with the direction of extension. The antenna wire is configured such that a per unit length area of the first extension part is larger than a per unit length area of the second extension part.

In this way, the flow of an electric current through the ring-shaped antenna wire causes a magnetic field to be generated on the center side of the antenna wire by an electromagnetic induction effect. The antenna wire is formed by the reticulated metal film, which has reticulations through which light is transmitted, whereby the translucency of the transparent antenna is secured. The wiring resistance of the antenna wire tends to become lower as the opening area of the reticulations in the metal film becomes smaller and the area of the metal film becomes larger, and tends to become higher as the opening area of the reticulations in the metal film becomes larger and the area of the metal film becomes smaller. Note here that the influence on the wiring resistance of the per unit length area of the first extension part, of the antenna wire, which extends along the direction of extension of the antenna wire, is relatively greater than the influence on the wiring resistance of the per unit length area of the second extension part, of the antenna wire, which extends along a direction intersecting with the direction of extension.

Moreover, since the antenna wire is configured such that the per unit length area of the first extension part, which extends along the direction of extension of the antenna wire, is larger than the per unit length area of the second extension part, which extends along a direction intersecting with the direction of extension, it is possible to efficiently lower the wiring resistance while sufficiently securing the opening area of the reticulations. This makes it possible to achieve a reduction in wiring resistance while achieving sufficient light transmittance.

It is preferable that embodiments of the first transparent antenna of the present invention be configured as follows:

(1) The antenna wire has a plurality of reticulations and a plurality of demarcation parts demarcating the reticulations, the demarcation parts being each constituted by a first demarcation part extending along the direction of extension and a second demarcation part extending along a direction intersecting with the direction of extension, the first extension part comprises a plurality of the first demarcation parts, and the second extension part comprises a plurality of the second demarcation parts. In this way, the per unit length area of the first extension part comprising the plurality of first demarcation parts is larger than the per unit length area of the second extension part comprising the plurality of second demarcation parts. This makes it possible to efficiently lower the wiring resistance while sufficiently securing the opening area of the reticulations. This in turn makes it possible to achieve a reduction in wiring resistance while achieving sufficient light transmittance.

(2) The first demarcation part has a line width that is greater than a line width of the second demarcation part. In this way, by making the line width of the first demarcation part wider than the line width of the second demarcation part, the per unit length area of the first extension part comprising a plurality of the first demarcation parts can be made larger than the per unit length area of the second extension part comprising a plurality of the second demarcation parts.

(3) A spacing between adjacent ones of the second demarcation parts is wider than a spacing between adjacent ones of the first demarcation parts. In this way, by making the spacing between adjacent second demarcation parts wider than the spacing between adjacent first demarcation parts, the opening area of the reticulations can be expanded.

This makes it possible to suitably achieve a reduction in wiring resistance by making the line width of the first demarcation part relatively wider and to, by making the spacing between adjacent second demarcation parts relatively wider, ensure the opening area of the reticulation as usual while maintaining the wiring resistance.

(4) A spacing between adjacent ones of the first demarcation parts is narrower than a spacing between adjacent ones of the second demarcation parts. In this way, by making the spacing between adjacent first demarcation parts narrower than the spacing between adjacent second demarcation parts, the number of first demarcation parts provided is made larger than the number of second demarcation parts provided. This allows the per unit length area of the first extension part comprising the plurality of first demarcation parts to be larger than the per unit length area of the second extension part comprising the plurality of second demarcation parts. Moreover, by appropriately adjusting the spacing between adjacent second demarcation parts, it is made possible to ensure the opening area of the reticulations as usual while maintaining the wiring resistance.

(5) The antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends along the first direction and the second demarcation part extends along the second direction, and the second side parts are each configured such that the first demarcation part extends along the second direction and the second demarcation part extends along the first direction. In this way, in each of the first side parts, of the antenna wire having a planar shape forming a quadrangular ring, which extend parallel to the first direction, the per unit length area of the first extension part comprising a plurality of the first demarcation parts extending along the first direction is larger than the per unit length area of the second extension part comprising a plurality of the second demarcation parts extending along the second direction orthogonal to the first direction. On the other hand, in each of the second side parts, of the antenna wire, which extend parallel to the second direction, the per unit length area of the first extension part comprising a plurality of the first demarcation parts extending along the second direction is larger than the per unit length area of the second extension part comprising a plurality of the second demarcation parts extending along the first direction. This makes it possible to achieve a reduction in wiring resistance while achieving sufficient light transmittance.

(6) The antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends along a direction inclined with respect to the first and second directions and the second demarcation part extends along the second direction, and the second side parts are each configured such that the first demarcation part extends along a direction inclined with respect to the first and second directions and the second demarcation part extends along the first direction. In this way, in each of the first side parts, of the antenna wire having a planar shape forming a quadrangular ring, which extend parallel to the first direction, the per unit length area of the first extension part comprising a plurality of the first demarcation parts extending along a direction inclined with respect to the first and second directions is larger than the per unit length area of the second extension part comprising a plurality of the second demarcation parts extending along the second direction orthogonal to the first direction. On the other hand, in each of the second side parts, of the antenna wire, which extend parallel to the second direction, the per unit length area of the first extension part comprising a plurality of the first demarcation parts extending along a direction inclined with respect to the first and second directions is larger than the per unit length area of the second extension part comprising a plurality of the second demarcation parts extending along the first direction. This makes it possible to achieve a reduction in wiring resistance while achieving sufficient light transmittance.

(7) The antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to intersect with the first direction and the second direction and has a planar shape forming a curve and the second demarcation part extends along the second direction, and the second side parts are each configured such that the first demarcation part extends in such a form as to intersect with the first direction and the second direction and has a planar shape forming a curve and the second demarcation part extends along the first direction. In this way, in each of the first side parts, of the antenna wire having a planar shape forming a quadrangular ring, which extend parallel to the first direction, the per unit length area of the first extension part comprising a plurality of the first demarcation parts each extending in such a form as to intersect with the first direction and the second direction and having a planar shape forming a curve is larger than the per unit length area of the second extension part comprising a plurality of the second demarcation parts extending along the second direction orthogonal to the first direction. On the other hand, in each of the second side parts, of the antenna wire, which extend parallel to the second direction, the per unit length area of the first extension part comprising a plurality of the first demarcation parts extending in such a form as to intersect with the first direction and the second direction and having a planar shape forming a curve is larger than the per unit length area of the second extension part comprising a plurality of the second demarcation parts extending along the first direction. This makes it possible to achieve a reduction in wiring resistance while achieving sufficient light transmittance.

(8) The antenna wire has a planar shape forming a quadrangular ring and has a pair of first side parts extending parallel to a first direction, a pair of second side parts extending parallel to a second direction orthogonal to the first direction, and corner parts connecting the first side parts and the second side parts, the first side parts and the second side parts each have the first extension part and the second extension part, the corner parts each have a corner-part first extension part extending parallel to the first direction and a corner-part second extension part extending parallel to the second direction, and the corner parts are each configured such that the corner-part first extension part and the corner-part second extension part are equal in per unit length area to each other. In this way, since the first side parts extend parallel to the first direction and the second side parts extend parallel to the second direction orthogonal to the first direction, the per unit length area of the first extension part in each of the first and second side parts is larger than the per unit length area of the second extension part in each of the first and second side parts. This makes it possible to efficiently lower the wiring resistance while sufficiently securing the opening area of the reticulations in the first side parts and the second side parts. Meanwhile, since the corner parts connect the first side parts and the second side parts, the corner-part first extension part and the corner-part second extension part are equal in per unit length area to each other. This makes it difficult for the first side parts and the second side parts to differ from each other in terms of the opening area of the reticulations and the wiring resistance.

(9) The corner parts are each configured such that the per unit length area of the corner-part first extension part is smaller than the per unit length area of the first extension part constituting the first side parts and the second side parts and the per unit length area of the corner-part second extension part is larger than the per unit length area of the second extension part constituting the first side parts and the second side parts. In this way, the per unit length areas of the corner-part first and second extension parts constituting the corner part are appropriate. This makes it more difficult for the first side parts and the second side parts to differ from each other in terms of the opening area of the reticulations and the wiring resistance.

(10) A lead wiring part extending in such a form as to lead from the antenna wire is further included, the lead wiring part has a first lead extension part extending along a direction of extension of the lead wiring part and a second lead extension part extending along a direction intersecting with the direction of extension of the lead wiring part, and the lead wiring part is configured such that a per unit length area of the first lead extension part is larger than a per unit length area of the second lead extension part. In this way, the flow of an electric current through the ring-shaped antenna wire due to the passage of electricity through the lead wiring part causes a magnetic field to be generated on the center side of the antenna wire by an electromagnetic induction effect. This lead wiring part is configured such that the per unit length area of the first lead extension part extending along the direction of extension of the lead wiring part is larger than the per unit length area of the second lead extension part extending along a direction intersecting with the direction of extension of the lead wiring part. This makes it possible to efficiently lower the wiring resistance while sufficiently securing the opening area of the reticulations. This in turn makes it possible to achieve a reduction in wiring resistance while achieving sufficient light transmittance.

A second transparent antenna of the present invention includes an antenna wire, formed by a reticulated metal film in a shape of a ring, which generates a magnetic field on a center side thereof. The antenna wire has a first extension part extending along a direction inclined with respect to both a direction of extension of the antenna wire and a direction orthogonal thereto and a second extension part extending along a direction inclined with respect to both the direction of extension and the direction orthogonal thereto and intersecting with the first extension part. The antenna wire is configured such that each of the first and second extension parts is inclined at a smaller angle with respect to the direction of extension than with respect to the direction orthogonal to the direction of extension.

In this way, the flow of an electric current through the ring-shaped antenna wire causes a magnetic field to be generated on the center side of the antenna wire by an electromagnetic induction effect. The antenna wire is formed by the reticulated metal film, which has reticulations through which light is transmitted, whereby the translucency of the transparent antenna is secured. The wiring resistance of the antenna wire tends to become lower as the opening area of the reticulations in the metal film becomes smaller and the area of the metal film becomes larger, and tends to become higher as the opening area of the reticulations in the metal film becomes larger and the area of the metal film becomes smaller. Note here that, in the first extension part extending along a direction inclined with respect to both the direction of extension of the antenna wire and a direction orthogonal thereto and the second extension part extending along a direction inclined with respect to both the direction of extension of the antenna wire and the direction orthogonal thereto and intersecting with the direction of extension of the first extension part, the path length in the direction of extension of the antenna wire tends to become longer and the path length in the direction orthogonal to the direction of extension of the antenna wire tends to become shorter as the angle of inclination with respect to the direction of extension of the antenna wire becomes larger and the angle of inclination with respect to the direction orthogonal to the direction of extension of the antenna wire becomes smaller, and the path length in the direction of extension of the antenna wire tends to become shorter and the path length in the direction orthogonal to the direction of extension of the antenna wire tends to become longer as the angle of inclination with respect to the direction of extension of the antenna wire becomes smaller and the angle of inclination with respect to the direction orthogonal to the direction of extension of the antenna wire becomes larger.

Moreover, since the antenna wire is configured such that each of the first and second extension parts is inclined at a smaller angle with respect to the direction of extension of the antenna wire than with respect to the direction orthogonal to the direction of extension of the antenna wire, the path length in the direction of extension of the antenna wire becomes shorter. This makes it possible to efficiently lower the wiring resistance while sufficiently securing the opening area of the reticulations. This in turn makes it possible to achieve a reduction in wiring resistance while achieving sufficient light transmittance.

Next, in order to solve the problems, a transparent antenna-equipped display device of the present invention includes: a transparent antenna described above; a transparent antenna substrate provided with the transparent antenna; and a display panel, stacked on the transparent antenna substrate, which has a display region that is capable of displaying an image and a non-display region surrounding the display region. The transparent antenna is placed in a position overlapping the display region.

In this way, the use of the transparent antenna placed in a position overlapping the display region of the display panel makes it possible to perform communication, for example, with an external device or the like. This makes it possible to perform an operation such as bringing the external device closer to the transparent antenna in accordance with an image displayed on the display region, thus offering great convenience. Moreover, the antenna performance of the transparent antenna is so high that communication with the external device or the like can be satisfactorily performed.

It is preferable that the transparent antenna-equipped display device of the present invention be configured as follows:

(1) The display panel has a large number of pixels arranged in a matrix in a plane of a display surface of the display panel, the transparent antenna has a large number of reticulations arranged in a matrix, and a direction of arrangement of the reticulations is inclined with respect to a direction of arrangement of the pixels. In this way, the inclination of the direction of arrangement of the reticulations of the transparent antenna with respect to the direction of arrangement of the pixels in the display panel reduces the appearance of interference fringes called moiré, thereby bringing about improvement in display quality.

Advantageous Effects of Invention

The present invention makes it possible to achieve a reduction in wiring resistance while achieving sufficient light transmittance.

DESCRIPTION OF EMBODIMENTS

Embodiment 1

Embodiment 1 of the present invention is described with reference to FIGS. 1 to 10. The present embodiments illustrates a transparent antenna-equipped liquid crystal display device 10 that enables communication with an external device (not illustrated) via a transparent antenna 17. It should be noted that part of each of the drawings shows an X axis, a Y axis, and a Z axis and each of the drawings is drawn to indicate directions along these axes, respectively.

Figure 1:
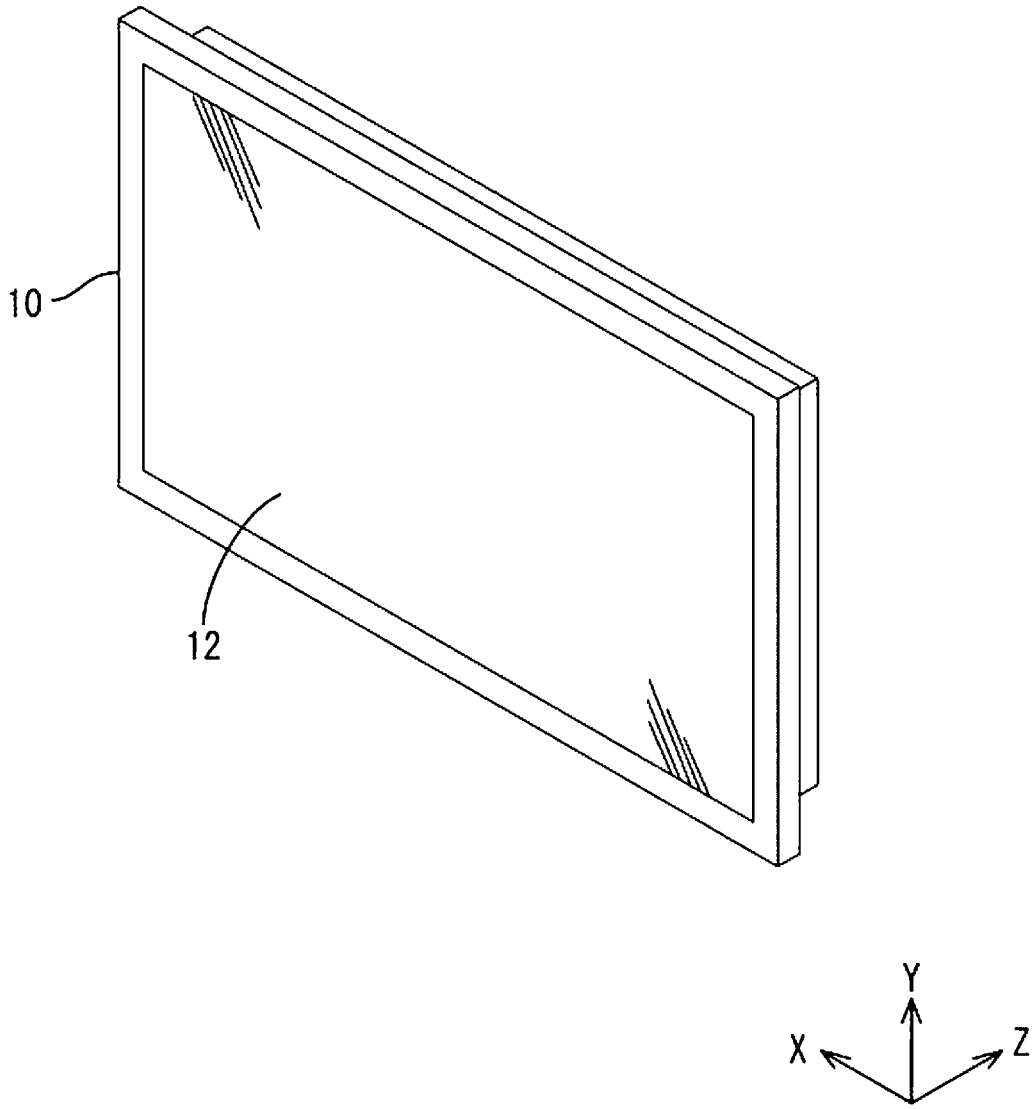
FIG. 1 is a perspective view of a liquid crystal display device according to Embodiment 1 of the present invention.

First, a configuration of the liquid crystal display device 10 is described. As shown in FIG. 1, the liquid crystal display device 10 includes a liquid crystal panel (display panel) 11 that displays an image, a transparent antenna substrate 12 placed opposite an outer side (front side) of the liquid crystal panel 11 and provided with the transparent antenna 17, and a backlight device (lighting device) 13 serving as an external light source that emits light toward the liquid crystal panel 11. Of these components, the liquid crystal panel 11 and the transparent antenna substrate 12, which are stacked opposite each other, are firmly fixed to and integrated with each other by a substantially transparent adhesive (not illustrated) sandwiched therebetween. A preferred example of the adhesive is an OCA (optical clear adhesive) tape or the like. Further, the liquid crystal display device 10 includes a chassis 14 accommodating the backlight device 13, a frame 15 holding the backlight device 13 between the chassis 14 and the frame 15, and a bezel 16 holding the liquid crystal panel 11 and the transparent antenna substrate 12 between the frame 15 and the bezel 16.

The liquid crystal display device 10 according to the present embodiment is one that is used in any of various types of electronic device (not illustrated) such as information displays, electronic blackboards, and television receiving apparatuses. For this purpose, the liquid crystal panel 11 of the liquid crystal display device 10 has a screen size of approximately 30-something inches to 50-something inches, which are generally categorized into medium to large sizes.

Further, it is preferable that the liquid crystal display device 10 communicate with an external device under a short-distance radio communication scheme such as NFC (Near Field Communication). Specific examples of external devices that perform short-distance radio communication with the liquid crystal display device 10 include IC cards, smartphones, and the like each of which contains a device-side antenna. A user is enabled to perform short-distance radio communication between the device-side antenna of an external device such as an IC card or a smartphone and the transparent antenna 17 by bringing the external device closer to the transparent antenna 17 in accordance with a display shown on the liquid crystal display device 10.

Figure 2:
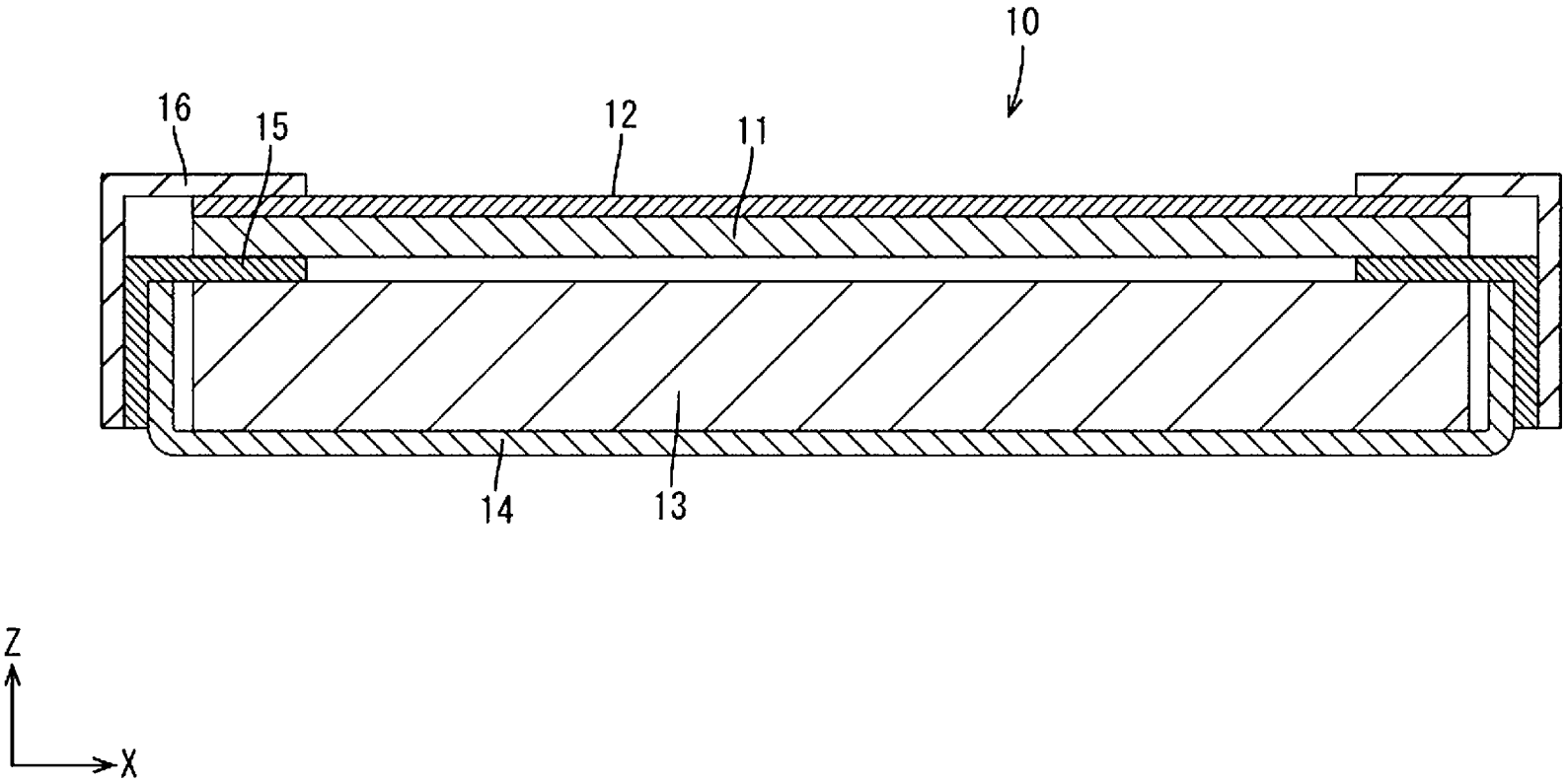
FIG. 2 is a cross-sectional view schematically showing a configuration of the liquid crystal display device.
Figure 3:
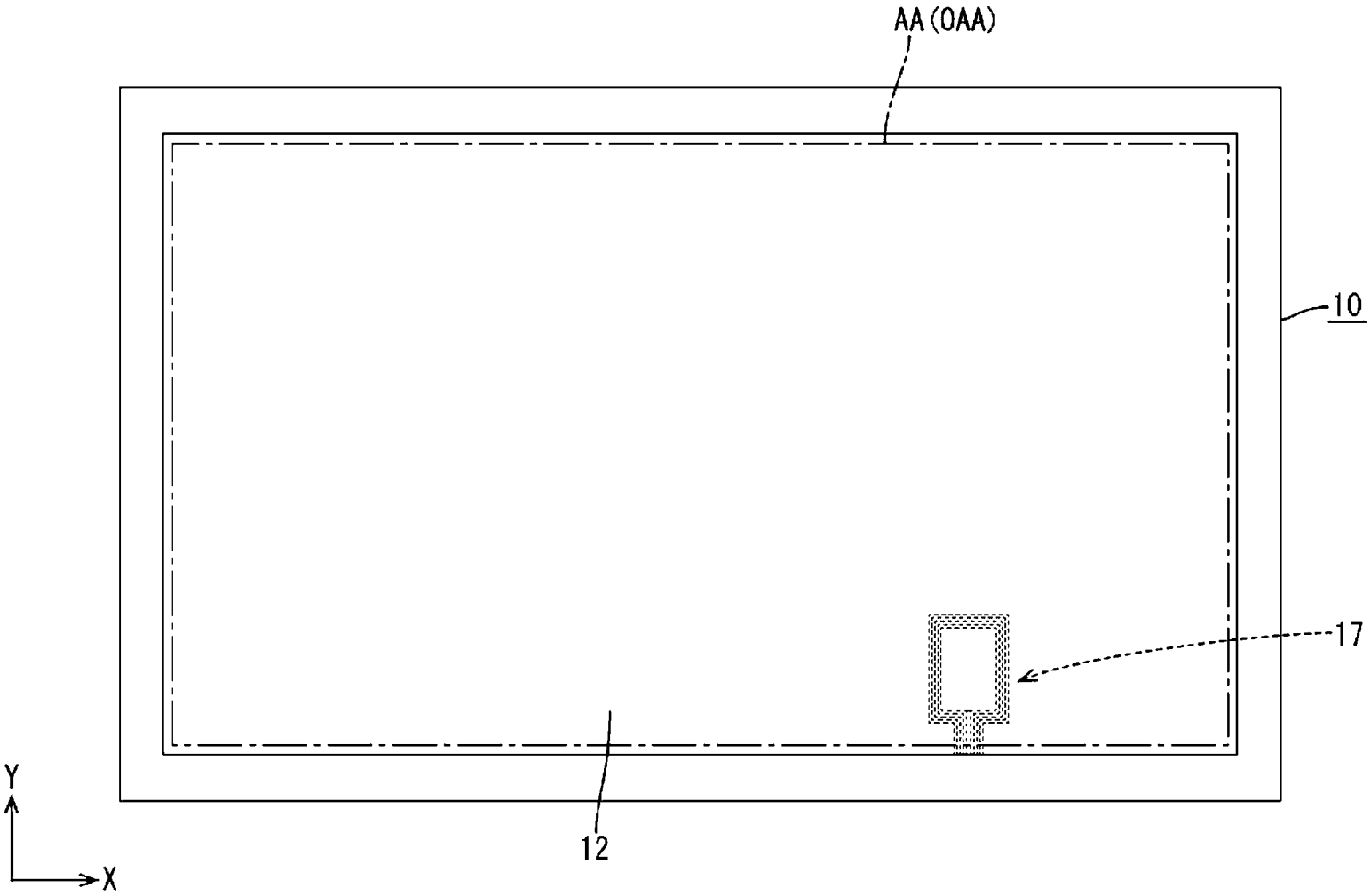
FIG. 3 is a front view of the liquid crystal display device.

As shown in FIGS. 2 and 3, the liquid crystal panel 11 has a horizontally long quadrangular shape (rectangular shape) when seen in a plan view and includes a pair of highly translucent glass substrates bonded to each other with a predetermined gap therebetween and a liquid crystal sealed in between the substrates. The liquid crystal panel 11 is incorporated into the liquid crystal display device 10 in such a position that the long sides, short sides, and thickness of the liquid crystal panel 11 extend along the X axis, the Y axis, and the Z axis, respectively. One of the two substrates is a substrate (array substrate) provided with switching elements (e.g. TFTs) connected to source wires and gate wires that are orthogonal to each other, pixel electrodes connected to the switching elements, an alignment film, and the like, and the other of the two substrates is a substrate (CF substrate) provided with a color filter including an predetermined arrangement of colored portions, for example, of R (red), G (green), and B (blue), counter electrodes, an alignment film, and the like. The liquid crystal panel 11 has its display surface divided into a display region (active area) AA and a non-display region (non-active area) NAA. The display region AA, located in the middle of the screen, is capable of displaying an image, and the non-display region NAA, located at the outer edges of the screen, is in the shape of a frame surrounding the display region AA. Whereas the display region AA has a horizontally long quadrangular shape, the non-display region NAA is in the shape of a horizontally long frame. In FIG. 3, the display region AA is surrounded by a dashed-dotted line, and the non-display region NAA is on the outer side of the dashed-dotted line. The display region AA of the liquid crystal panel 11 includes a large number of pixels arranged in a matrix along the X axis and the Y axis in the plane of the display surface. These pixels are constituted by the pixel electrodes of the array substrate and the color filter (colored portions) of the CF substrate. It should be noted that a pair of front and back polarizing plates are bonded to outer surfaces of the two substrates, respectively. The backlight device 13, which supplies light to the liquid crystal panel 11 thus configured, includes at least a light source (e.g. cold-cathode tubes, LEDs, organic EL, or the like) and an optical member having an optical function, for example, of transforming emission from the light source into surface emission.

Figure 4:
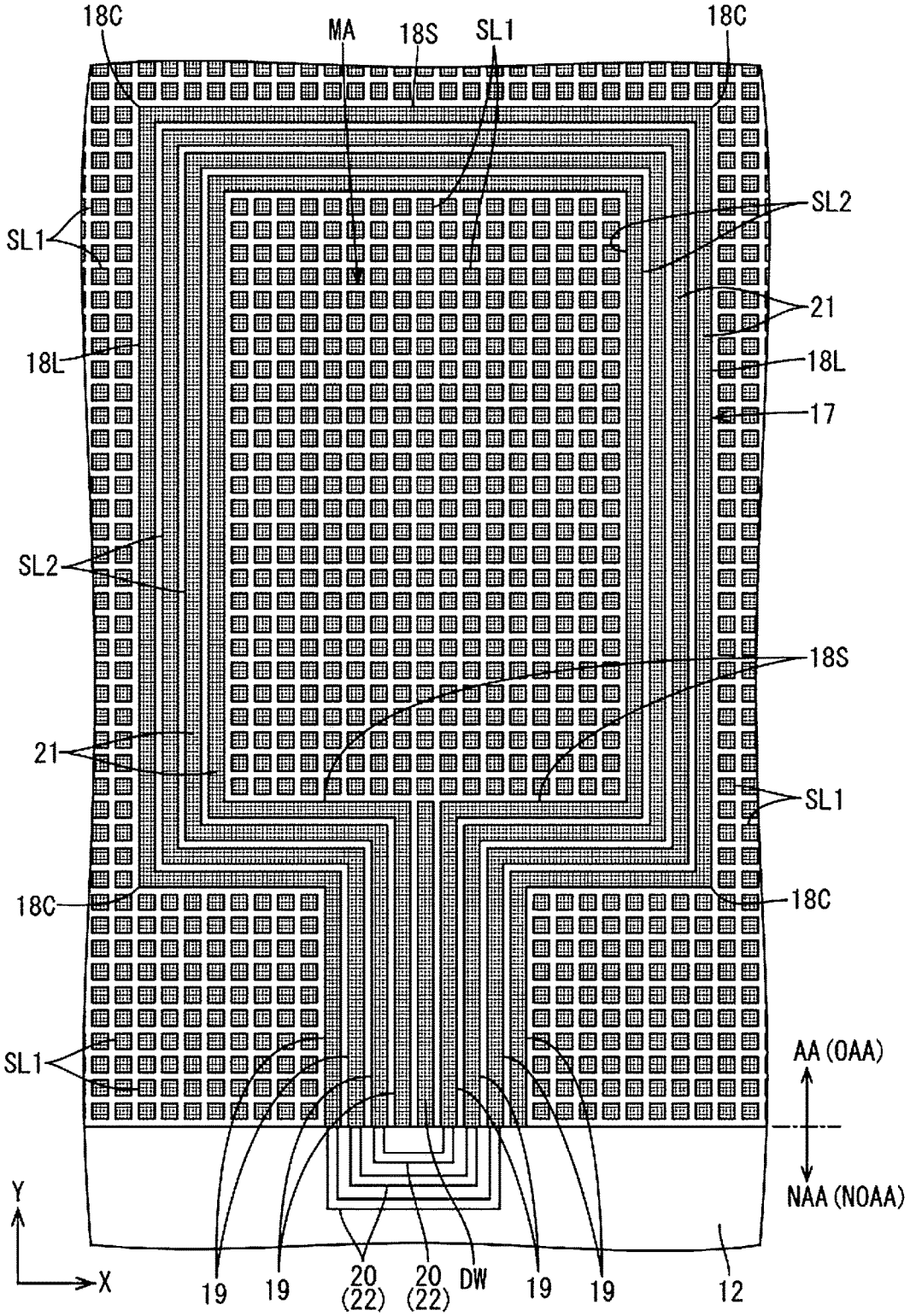
FIG. 4 is a plan view of a transparent antenna.

Next, the transparent antenna substrate 12 and the transparent antenna 17 provided thereon are described. The transparent antenna substrate 12 is made of a synthetic resin material such as PET (polyethylene terephthalate), is high in translucency, and is substantially transparent. As shown in FIGS. 2 and 3, the transparent antenna substrate 12 is in the shape of a sheet that is substantially the same in size and external shape as the liquid crystal panel 11 when seen in a plan view. It should be noted that, in FIG. 3, the transparent antenna 17 is illustrated by a dashed line. Therefore, as shown in FIG. 4, the transparent antenna substrate 12 has a display overlap region OAA that overlaps the display region AA of the liquid crystal panel 11 when seen in a plan view and a non-display overlap region NOAA that overlaps the non-display region NAA of the liquid crystal panel 11 when seen in a plan view. The transparent antenna substrate 12 has a reticulated (meshed) metal film formed on an inner surface thereof, i.e. a surface thereof that faces the liquid crystal panel 11, and part of the reticulated metal film constitutes the transparent antenna 17. The reticulated metal film is formed by forming a light-blocking solid metal film on the transparent antenna substrate 12 and then patterning a large number of reticulations (meshes, openings) ME by subjecting the solid metal film to etching and the like and light passing through the reticulations ME allows the transparent antenna substrate 12 to ensure a certain degree of light transmittance. The large number of reticulations ME patterned in the reticulated metal film are regularly arranged in a matrix in the plane of the transparent antenna substrate 12. The planar shape of each of the reticulations ME is a quadrangle. The reticulations ME are placed at diagonal pitches of, for example, approximately 0.5 mm from each other.

As shown in FIG. 4, the reticulated metal film is formed substantially all over the surface of the transparent antenna substrate 12 in the display overlap region OAA. This makes it difficult for the transparent antenna substrate 12 to differ in light transmittance (transparency) between an antenna-containing region in which the transparent antenna 17 is formed and an antenna-free region in which the transparent antenna 17 is not formed. That is, the display overlap region OAA is a reticulated metal film-containing region. Further, slits SL1 forming a grid are formed in the antenna-free region (including a magnetic field generation region MA described below) of the reticulated metal film, and slits SL2 for defining the transparent antenna 17 are formed in the antenna-containing region of the reticulated metal film. The slits SL2 will be described later. The width of each of the slits SL1 forming the grid is greater than the opening width of each of the reticulations ME. It should be noted that FIG. 4 illustrates the slits SL1 and SL2 in white. In contrast to this, a light-blocking film (not illustrated) and a non-reticulated metal film (solid metal film) that constitutes an antenna connection wiring part 20 described below are formed substantially all over the inner surface of the transparent antenna substrate 12 in the non-display overlap region NOAA. The reticulated metal film and the non-reticulated metal film are made of a highly conductive metal material such as copper.

As shown in FIG. 4, the transparent antenna 17 has its planar shape and wiring pattern defined by cutting the slits SL2 in the antenna-containing region of the reticulated metal film formed on the transparent antenna substrate 12. The transparent antenna 17 includes an antenna body part 18 and a lead wiring part 19. The antenna body part 18 is in the shape of a ring and generates a magnetic field on a center side thereof, and the lead wiring part 19 leads from the antenna body part 18. The transparent antenna 17 is configured such that the antenna body part 18 is placed in a position away from a boundary position between the display overlap region OAA and the non-display overlap region NOAA on the transparent antenna substrate 12 toward the middle of the screen of the liquid crystal panel 11 by a predetermined distance along the Y axis and that the lead wiring part 19 is placed between the boundary position and the antenna body part 18. The transparent antenna 17 is placed in its entirety in the display overlay region OAA of the transparent antenna substrate 12. In contrast to this, the non-display overlap region NOAA of the transparent antenna substrate 12 is provided with an antenna connection wiring part 20 that is connected to the lead wiring part 19 of the transparent antenna 17. Connecting the antenna connection wiring part 20 to an antenna power supply circuit (not illustrated) causes the transparent antenna 17 to be supplied with electric power, i.e. an electric current, for generating a magnetic field.

As shown in FIG. 4, the antenna body part 18 is in the shape of a closed ring surrounding the magnetic field generation region MA, located on a center side thereof, in which a magnetic field is generated, and the planar shape of the antenna body part 18 is a vertically long quadrangular shape. The antenna body part 18 has an inside dimension of, for example, approximately 85.6 mm along the long sides thereof and an inside dimension of, for example, approximately 54 mm along the short sides thereof. Further, the device-side antenna of the external device has substantially the same outside dimensions as the antenna body part 18. Therefore, bringing the device-side antenna closer to the antenna body part 18 in an appropriate plane position (true position) causes the device-side antenna to be placed overlapping the entirety of the magnetic field generation region MA and allows the device-side antenna to capture almost all of the magnetic field generated in the magnetic field generation region MA. The antenna body part 18 is placed in such a form that its long sides and short sides extend along the Y axis and the X axis, respectively. The antenna body part 18 includes a pair of short side parts (first side parts) 18S extending along an X-axis direction (first direction), a pair of long side parts (second side parts) 18L extending along a Y-axis direction (second direction), and four corner parts 18C connecting the short side parts 18S and the long side parts 18L. The antenna body part 18 allows a magnetic field to be generated in the magnetic field generation region MA by the electromagnetic induction effect of an electric current passed through the four side parts 18L and 18S. As such, the antenna body part 18 achieves a higher induced electromotive force than an antenna body part including three side parts. The antenna body part 18 includes a plurality of (in FIG. 4, four) quadrangularly-ringed antenna wires 21 radially arranged at spacings corresponding to the slits SL2. The plurality of antenna wires 21 are similar in planar shape to the antenna body part 18. One of the antenna wires 21 that is closer to the magnetic field generation region MA tends to be smaller in external shape and shorter in distance of surface extension (i.e. the length of each of the side parts 18L and 18S). On the other hand, one of the antenna wires 21 that is farther from the magnetic field generation region MA tends to be larger in external shape and longer in distance of surface extension. That is, an antenna wire 21 that is close to the magnetic field generation region MA is a size larger in external shape than an antenna wire 21 located adjacent to the antenna wire 21 on a side that is farther from the magnetic field generation region MA, and is completely surrounded by the adjacent antenna wire 21. Each of the antenna wires 21 has its two ends placed in the short side part 18S on the lower side (lead wiring part 19 side) of FIG. 4 and is connected to a different lead wiring part 19. Further, each of the antenna wires 21 has an axisymmetrical shape with respect to a center line extending along the Y axis.

As shown in FIG. 4, the lead wiring part 19 is routed in such a form as to extend from the boundary position between the display overplay region OAA and the non-display overlap region NOAA on the transparent antenna substrate 12 to the antenna body part 18 substantially straight along the Y-axis direction (second direction), i.e. the direction of extension of the long side parts 18L. The lead wiring part 19 includes a plurality of (in FIG. 4, eight) lead wiring parts 19 arranged along the X-axis direction (first direction) orthogonal to the direction of extension the lead wiring parts 19, and the number of lead wiring parts 19 provided is twice larger than the number of antenna wires 21 provided. An end of each of the lead wiring parts 19 that is on an antenna body part 18 side (i.e. the side from which the lead wiring part 19 leads) is connected to an end of the corresponding one of the antenna wires 21, and an end of each of the lead wiring parts 19 that is on an opposite side (i.e. the side to which the lead wiring part 19 leads or a boundary position side) is connected to the antenna connection wiring part 20. Further, a dummy wiring part DW electrically isolated from the transparent antenna 17 is placed in such a form as to be interposed between two of the lead wiring parts 19 that are closest to the middle in the direction (X-axis direction) along which they are arranged.

As shown in FIG. 4, the antenna connection wiring part 20 is constituted by the non-reticulated metal film formed in the non-display overlap region NOAA of the transparent antenna substrate 12. Therefore, the antenna connection wiring part 20 is relatively lower in wiring resistance per unit length or per unit area than the antenna body part 18 and the lead wiring parts 19 of the transparent antenna 17 formed by the reticulated metal film. The antenna connection wiring part 20 includes a plurality (in FIG. 4, three) short-circuit wiring parts 22 that short-circuit two lead wiring parts 19. The number of short-circuit wiring parts 22 provided takes on a value obtained by subtracting 2 from the number of lead wiring parts 19 provided. Two lead wiring parts 19 that are short-circuited by the short-circuit wiring parts 22 are connected to different antenna wires 21. Specifically, the lead wiring part 19 connected to a first end (on the left side of FIG. 4) of the outermost antenna wire 21 is short-circuited by the short-circuit wiring parts 22 with the lead wiring part 19 connected to a first end (on the right side of FIG. 4) of the second outermost antenna wire 21. The lead wiring part 19 connected to a second end (on the left side of FIG. 4) of the second outermost antenna wire 21 is short-circuited by the short-circuit wiring parts 22 with the lead wiring part 19 connected to a first end (on the right side of FIG. 4) of the second innermost (i.e. third outermost) antenna wire 21. The lead wiring part 19 connected to a second end (on the left side of FIG. 4) of the second innermost antenna wire 21 is short-circuited by the short-circuit wiring parts 22 with the lead wiring part 19 connected to a first end (on the right side of FIG. 4) of the innermost antenna wire 21. Moreover, the antenna connection wiring part 20 includes an input wiring part (not illustrated) connected to the lead wiring part 19 connected to a second end (on the right side of FIG. 4) of the outermost antenna wire 21 and an output wiring part (not illustrated) connected to the lead wiring part 19 connected to the first end (on the left side of FIG. 4) of the innermost antenna wire 21. All this causes an electric current flowing from the input wiring part to flow to the second outermost antenna wire 21 through the lead wiring part 19 and the short-circuit wiring parts 22 in a counterclockwise direction of FIG. 4 after flowing to the outermost antenna wire 21 through the lead wiring part 19 in the counterclockwise direction of FIG. 4 and then flow to the output wiring part after flowing to the second innermost antenna wire 21 through the lead wiring part 19 and the short-circuit wiring parts 22 in the counterclockwise direction of FIG. 4 and further flowing to the innermost antenna wire 21 through the lead wiring part 19 and the short-circuit wiring parts 22 in the counterclockwise direction of FIG. 4. Such a flow of an electric current through the antenna body part 18 in the counterclockwise direction of FIG. 4 generates, in the magnetic field generation region MA of the antenna body part 18, a magnetic field directed toward the near side of the paper surface of FIG. 4.

Incidentally, the Q value, which represents the antenna performance of the transparent antenna 17, is represented by formula "$2\pi fL/R$", where "L" is the inductance (induced electromotive force, "R" is the wiring resistance, and "f" is the resonant frequency. That is, the Q value tends to be proportional to the inductance and inversely proportional to the wiring resistance. This shows that the antenna performance of the transparent antenna 17 is effectively improved by increasing the inductance or lowering the wiring resistance. In particular, while the wiring resistance of the transparent antenna 17 is effectively lowered, for example, by reducing the opening area of the reticulations ME in the reticulated metal film constituting the transparent antenna 17 (i.e. the opening ratio of the transparent antenna 17), doing so undesirably invites a decrease in amount of light that is transmitted through the reticulations ME and, by extension, a decrease in light transmittance of the transparent antenna 17. On the other hand, increasing the opening area of the reticulations ME in the reticulated metal film to improve the light transmittance of the transparent antenna 17 undesirably invites an increase in wiring resistance of the transparent antenna 17 and, by extension, a decrease in antenna performance of the transparent antenna 17.

Figure 5:
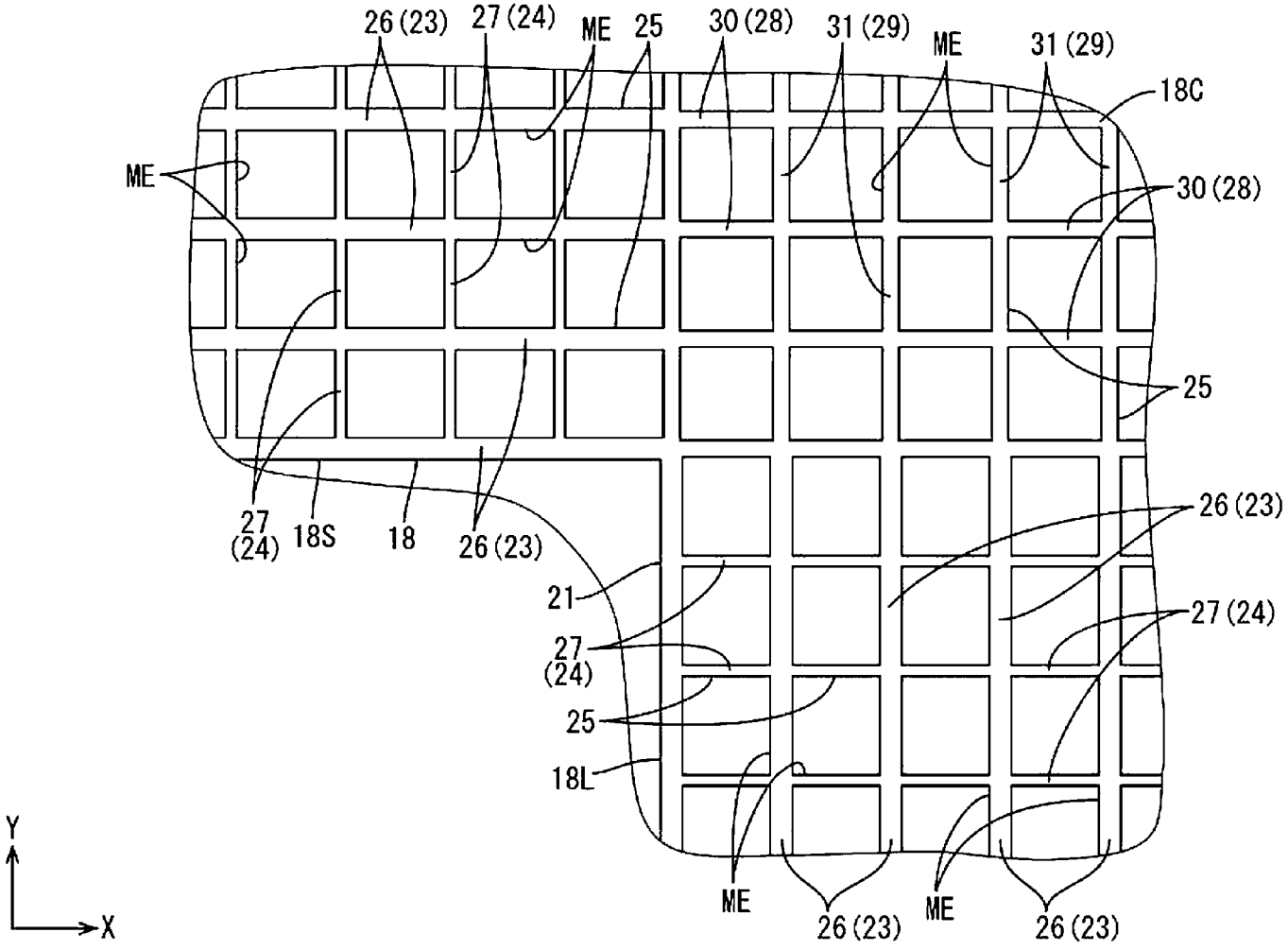
FIG. 5 is an enlarged plan view of an antenna body part of the transparent antenna.
Figure 6:
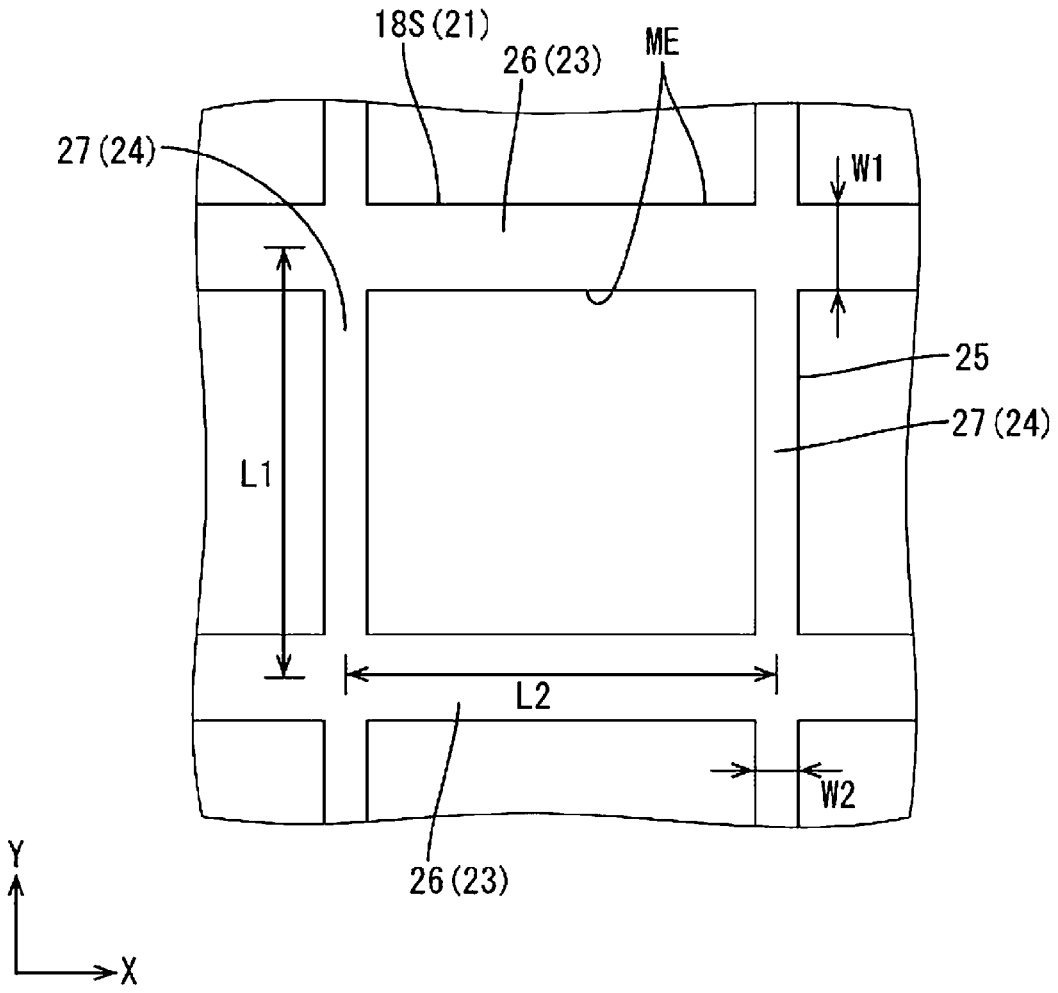
FIG. 6 is a plan view of demarcation parts in a short side part (first side part) of an antenna wire.
Figure 7:
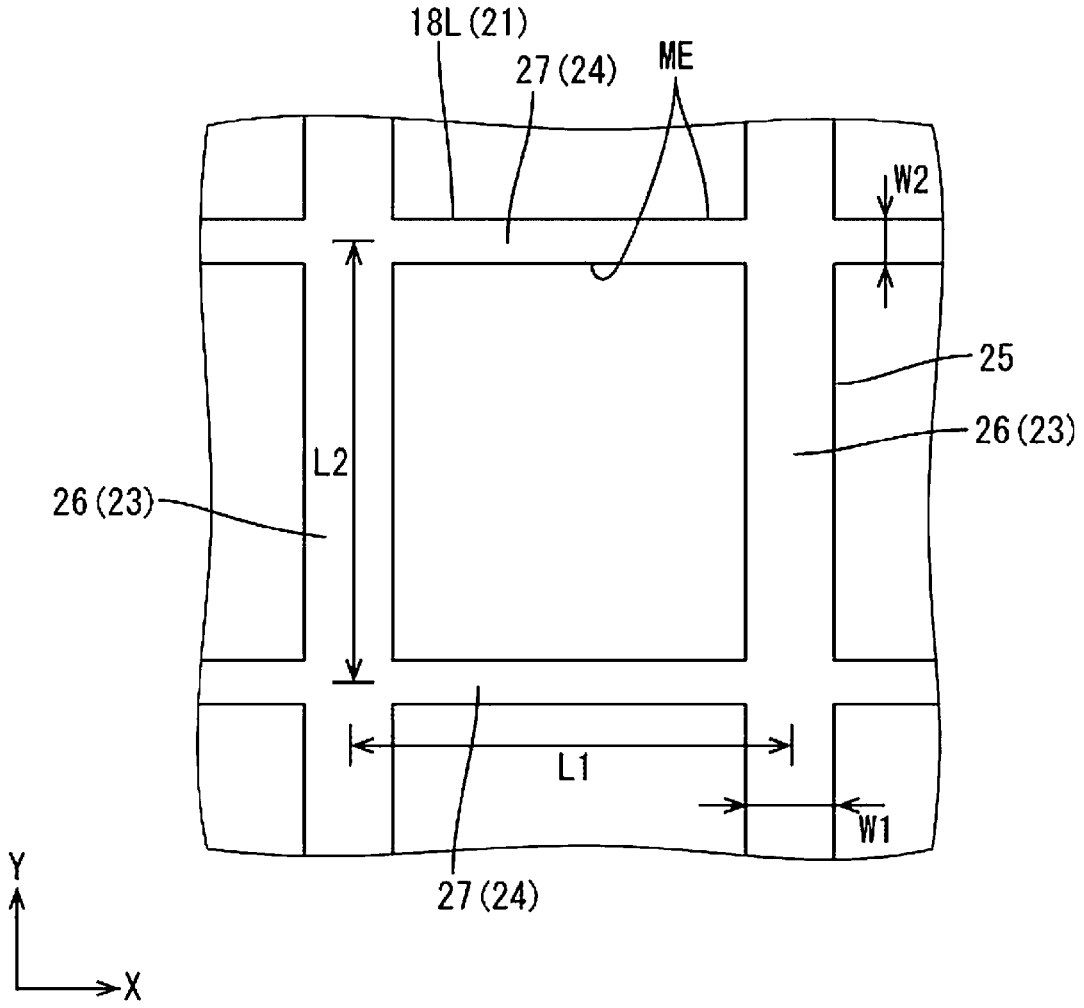
FIG. 7 is a plan view of demarcation parts in a long side part (second side part) of the antenna wire.

To address these problems, as shown in FIGS. 5 to 7, the transparent antenna 17 according to the present embodiment is configured such that when each of the antenna wires 21 is configured to have a first extension part 23 extending along the direction of extension of the antenna wire 21 and a second extension part 24 extending along a direction intersecting with the direction of extension, the per unit length area of the first extension part 23 is larger than the per unit length area of the second extension part 24. The influence on the wiring resistance of the per unit length area of the first extension part 23, of the antenna wire 21, which extends along the direction of extension of the antenna wire 21, is relatively greater than the influence on the wiring resistance of the per unit length area of the second extension part 24, of the antenna wire 21, which extends along a direction intersecting with the direction of extension. Therefore, such a configuration in which the per unit length area of the first extension part 23 is larger than the per unit length area of the second extension part 24 makes it possible, at least in the antenna body part 18, to efficiently lower the wiring resistance while sufficiently securing the opening area of the reticulations ME. This in turn makes it possible to achieve a reduction in wiring resistance while achieving sufficient light transmittance. It should be noted that since FIG. 6 is an enlarged plan view of a short side part (first side part) 18S of the antenna body part 18, the direction of extension of the antenna wire 21 coincides with the X-axis direction in FIG. 6. On the other hand, since FIG. 7 is an enlarged plan view of a long side part (second side part) 18L of the antenna body part 18, the direction of extension of the antenna wire 21 coincides with the Y-axis direction in FIG. 7.

As shown in FIG. 5, such first and second extension parts 23 and 24 differing in per unit length area from each other are had by the antenna wire 21 in each of the long and short side parts 18L and 18S, but not in any of the corner parts 18C. For this reason, it can be said that the first extension part 23 is a "side-part first extension part" and the second extension part 24 is a "side-part second extension part". Each of the corner parts 18C of the antenna wire 21 has a corner-part first extension part 28 extending parallel to a short side direction (first direction) of the antenna body part 18 and a corner-part second extension part 29 extending parallel to a long side direction (second direction) of the antenna body part 18, and is configured such that the corner-part first extension part 28 and the corner-part second extension part 29 are equal in per unit length area to each other. Therefore, in each of the corner parts 18C, there are no such first and second extension parts 23 and 24 differing in per unit length area from each other.

Figure 8:
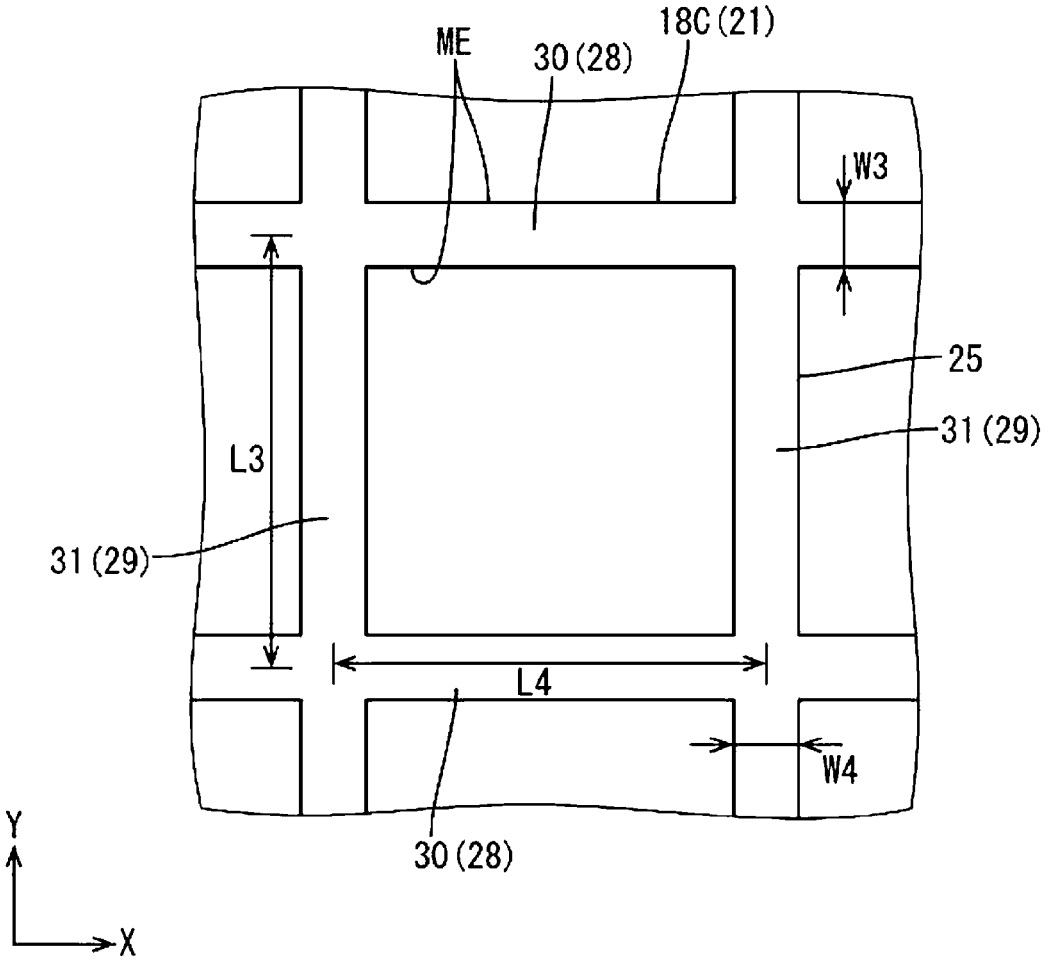
FIG. 8 is a plan view of demarcation parts in a corner part of the antenna wire.

As shown in FIG. 5, the reticulated metal film constituting the transparent antenna 17 has a larger number of demarcation parts 25 demarcating the large number of reticulations ME planarly arranged in a matrix. Those of the demarcation parts 25 which constitute the long and short side parts 18L and 18S of the antenna wire 21 are constituted by first demarcation parts (side-part first demarcation parts) 26 extending along the direction of extension of the antenna wire 21 and second demarcation parts (side-part second demarcation parts) 27 extending along a direction intersecting with the direction of extension of the antenna wire 21. In the present embodiment, since the planar shape of each of the reticulations ME is a quadrangular shape, a demarcation part 25 demarcating a reticulation ME in each of the side parts 18L and 18S is constituted by a pair of first demarcation parts 26 and a pair of second demarcation parts 27 whose directions of extension are orthogonal to each other. Whereas the first demarcation parts 26 extend substantially straight along the direction of extension of the antenna wire 21, the second demarcation parts 27 extend substantially straight along a direction intersecting with the direction of extension of the antenna wire 21. As shown in FIGS. 6 and 7, the spacing L1 between adjacent first demarcation parts 26 with a reticulation ME interposed therebetween is substantially equal to the spacing L2 between adjacent second demarcation parts 27 with a reticulation ME interposed therebetween. Meanwhile, those of the demarcation parts 25 which constitute the corner parts 18C of the antenna wire 21 have corner-part first demarcation parts 30 extending parallel to the short side direction (first direction) of the antenna body part 18 and corner-part second demarcation parts 31 extending parallel to the long side direction (second direction) of the antenna body part 18. In the present embodiment, since the planar shape of each of the reticulations ME is a quadrangular shape, a demarcation part 25 demarcating a reticulation ME in each of the corner parts 18C is constituted by a pair of corner-part first demarcation parts 30 and a pair of corner-part second demarcation parts 31 whose directions of extension are orthogonal to each other. As shown in FIG. 8, the spacing L3 between adjacent corner-part first demarcation parts 30 with a reticulation ME interposed therebetween is substantially equal to the spacing L4 between adjacent corner-part second demarcation parts 31 with a reticulation ME interposed therebetween.

Moreover, as shown in FIGS. 6 and 7, each of the first demarcation parts 26, which constitute each of the long and short side parts 18L and 18S of the antenna wire 21, is configured to have a line width W1 that is relatively greater than a line width W2 of each of the second demarcation parts 27. Therefore, the per unit length area of the first demarcation part 26 is relatively larger than the per unit length area of the second demarcation part 27. Whereas the first extension part 23 that the antenna wire 21 has in each of its side parts 18L and 18S is constituted by all of the first demarcation parts 26 provided in the corresponding one of the side parts 18L and 18S, the second extension part 24 that the antenna wire 21 has in each of its side parts 18L and 18S is constituted by all of the second demarcation parts 27 provided in the corresponding one of the side parts 18L and 18S. Therefore, whereas the first extension part 23 is relatively large in per unit length area, the second extension part 24 is relatively small in per unit length area. Meanwhile, as shown in FIG. 8, each of the corner-part first demarcation parts 30, which constitute each the corner parts 18C of the antenna wire 21, is configured to have a line width W3 that is substantially equal to a line width W4 of each of the corner-part second demarcation parts 31. Therefore, the per unit length area of the corner-part first demarcation part 30 is substantially equal to the per unit length area of the corner-part second demarcation part 31. Whereas the corner-part first extension part 28 that the antenna wire 21 has in each of its corner parts 18C is constituted by all of the corner-part first demarcation parts 30 provided in the corresponding one of the corner parts 18C, the corner-part second extension part 29 that the antenna wire 21 has in each of its corner parts 18C is constituted by all of the corner-part second demarcation parts 31 provided in the corresponding one of the corner parts 18C. Therefore, the corner-part first extension parts 28 and the corner-part second extension parts 29 are substantially equal in per unit length area to each other.

Specifically, as shown in FIG. 6, the first extension part 23 that the antenna wire 21 has in each of its short side parts 18S comprises a plurality of first demarcation parts 26 extending along the X-axis direction, which is the direction of extension of the short side part 18S. Therefore, the line width W1 of each of the first demarcation parts 26 is wider than the line width W2 of each of the second demarcation parts 27 extending along the Y-axis direction orthogonal to the direction of extension of the short side part 18S, whereby the per unit length area of the first extension part 23 is larger than the per unit length area of the second extension part 24 comprising the plurality of second demarcation parts 27. On the other hand, as shown in FIG. 7, the first extension part 23 that the antenna wire 21 has in each of its long side parts 18L comprises a plurality of first demarcation parts 26 extending along the Y-axis direction, which is the direction of extension of the long side part 18L. Therefore, the line width W1 of each of the first demarcation parts 26 is greater than the line width W2 of each of the second demarcation parts 27 extending along the Y-axis direction orthogonal to the direction of extension of the long side part 18L, whereby the per unit length area of the first extension part 23 is larger than the per unit length area of the second extension part 24 comprising the plurality of second demarcation parts 27.

Figure 9:
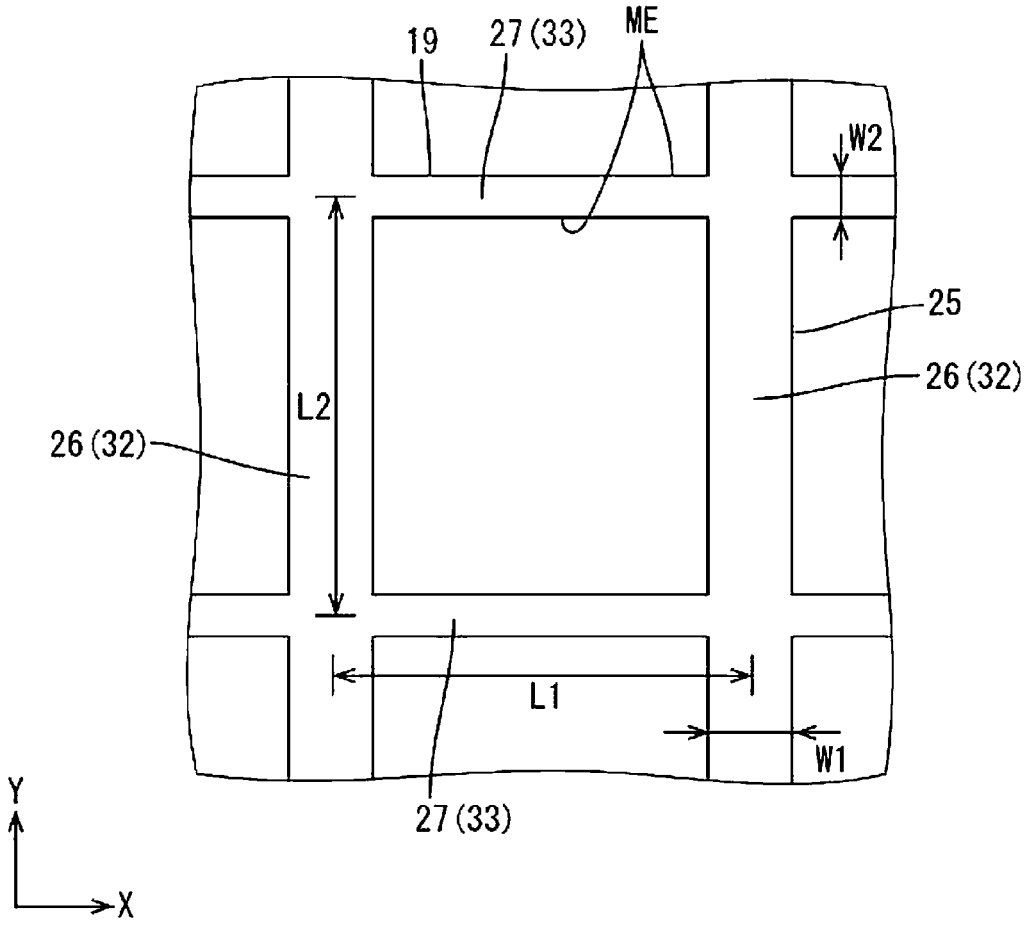
FIG. 9 is a plane view of demarcation parts in a lead wiring part.

Furthermore, as shown in FIG. 9, the transparent antenna 17 is configured such that when each of the lead wiring parts 19 is configured to have a first lead extension part 32 extending along the direction of extension of the lead wiring part 19 and a second lead extension part 33 extending along a direction intersecting with the direction of extension, the per unit length area of the first lead extension part 32 is larger than the per unit length area of the second lead extension part 33. The demarcation part 25 that this lead wiring part 19 has is identical in configuration to the demarcation part 25 that the antenna wire 21 has in each of its side parts 18L and 18S and, as such, comprises first demarcation parts 26 whose line width W1 is relatively great and second demarcation parts 27 whose line width W2 is relatively small. It should be noted that, for convenience, the demarcation parts 26 and 27 that the lead wiring part 19 has are given the same reference signs as those given to the demarcation parts 26 and 27 that the antenna wire 21 has in each of its side parts 18L and 18S. For this reason, the first lead extension part 32 comprises a plurality of first demarcation parts 26 extending along the Y-axis direction, which is the direction of extension of the lead wiring part 19. Therefore, the line width W1 of each of the first demarcation parts 26 is greater than the line width W2 of each of the second demarcation parts 27 extending along the Y-axis direction orthogonal to the direction of extension of the lead wiring part 19, whereby the per unit length area of the first lead extension part 32 is larger than the per unit length area of the second lead extension part 33 comprising the plurality of second demarcation parts 27. This makes it possible, in the lead wiring part 19, too, to efficiently lower the wiring resistance while sufficiently securing the opening area of the reticulations ME.

Figure 10:
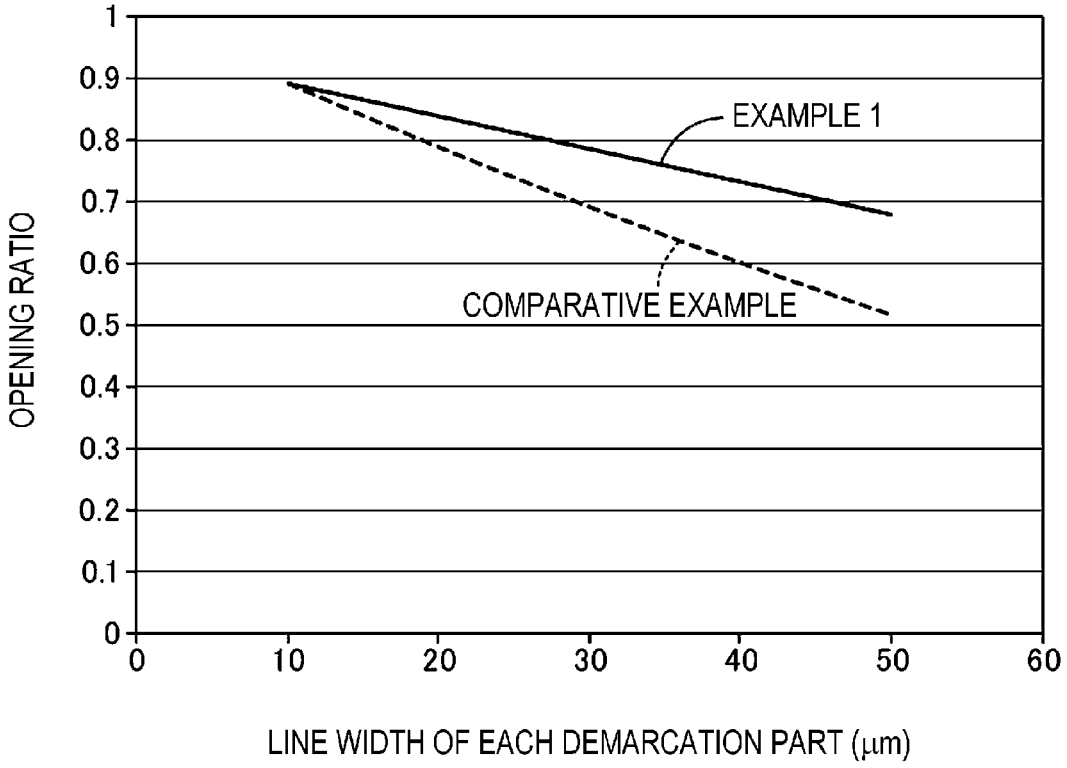
FIG. 10 is a graph showing a relationship between the opening ratios of transparent antennas of Comparative Example and Example 1 and the line width of each demarcation part in Comparative Experiment 1.

The following describes Comparative Experiment 1, which was conducted to find out how the opening ratio of the transparent antenna 17 thus configured varies according to the line width of each of the demarcation parts 26 and 27. In Comparative Experiment 1, Comparative Example is a transparent antenna whose antenna body part includes antenna wires each having, in each of its side parts, first and second demarcation parts that are equal in line width to each other, and Example 1 is a transparent antenna 17 whose antenna body part 18 includes antenna wires 21 each having, in each of its side parts 18L and 18S, first and second demarcation parts 26 and 27 with each of the first demarcation parts 26 having a line width W1 that is greater than a line width W2 of each of the second demarcation parts 27, i.e. a transparent antenna 17 described in the preceding paragraphs. In Comparative Experiment 1, the line width W1 of each of the first demarcation parts 26 of Example 1 is equal to the line width of each of the demarcation parts of Comparative Example, and the line width W2 of each of the second demarcation parts 27 of Example 1 takes on such a value that the wiring resistance of the transparent antenna 17 of Example 1 is equal to the wiring resistance of the transparent antenna of Comparative Example. In Comparative Example and Example 1, the spacings between adjacent first demarcation parts with a reticulation interposed therebetween and the spacings between adjacent second demarcation parts with a reticulation interposed therebetween are all identical. FIG. 10 shows the results of calculation of the opening ratio of each of the transparent antennas of Comparative Example and Example 1 with varying line widths of each demarcation part.

In FIG. 10, the horizontal axis represents the line width of each demarcation part (in units of "μm"), and the vertical axis represents the opening ratio of each of the transparent antennas (no unit of quantity required). Specifically, in terms of Comparative Example, the horizontal axis of FIG. 10 represents the line width of each demarcation part, and in terms of Example 1, the horizontal axis of FIG. 10 represents the line width W1 of each first demarcation part 26. The term "opening ratio of a transparent antenna" here means the ratio of the total area of all of the reticulations ME included in the transparent antenna to the area of the region of the transparent antenna substrate in which the transparent antenna is formed. In FIG. 10, the graphs of Comparative Example and Example 1 are identical in wiring resistance at the same position on the horizontal axis. In FIG. 10, the wiring resistance tends to become lower rightward on the horizontal axis (as the line width becomes greater), and on the other hand, the wiring resistance tends to become higher leftward on the horizontal axis (as the line width becomes narrower). In FIG. 10, the solid line graph represents the experimental result of Example 1, and the dashed line graph represents the experimental result of Comparative Example. The opening ratio of each of the transparent antennas of Comparative Example and Example 1 was calculated in the following manner. In Comparative Example, the opening ratio of the transparent antenna was calculated from formula "(Lref–Wref)2/Lref2", where "Lref" is the spacing between adjacent first demarcation parts with a reticulation interposed therebetween and the spacing between adjacent second demarcation parts with a reticulation interposed therebetween and "Wref" is the line width of each first demarcation part and the line width of each second demarcation part. In Example 1, the opening ratio of the transparent antenna 17 was calculated from formula "(L1–W1)(L2–W2)/L1·L2", where "L1" is the spacing between adjacent first demarcation parts 26 with a reticulation ME interposed therebetween, "L2" is the spacing between adjacent second demarcation parts 27 with a reticulation ME interposed therebetween, "W1" is the line width of each first demarcation part 26, and "W2" is the line width of each second demarcation part 27. It should be noted that, in Comparative Experiment 1, formulas "W1=Wref>W2" and "L1=L2=Lref" hold.

Here are the experimental results of Comparative Experiment 1. According to FIG. 10, the opening ratio of each of the transparent antennas of Comparative Example and Example 1 tend to become gradually lower with increase in line width of each demarcation part. Moreover, Example 1 is gentler in slope of the graph and slower in decrease of the opening ratio of the transparent antenna entailed by an increase in line width of each demarcation part than Comparative Example. Therefore, the difference in opening ratio between the transparent antennas of Example 1 and Comparative Example tends to become greater with increase in line width W1 or W2 of each demarcation part 26 or 27. In Example 1, since the line width W2 of each second demarcation part 27 is narrower than the line width W1 of each first demarcation part 26, the opening ratio of the transparent antenna 17 is higher by the difference between the line widths W1 and W2. In Comparative Example, on the other hand, it is conceivable that the same opening ratio may be achieved, for example, by causing the line width Wref of each demarcation part to take on a value that is narrower than W1 and greater than W2. However, doing so makes it impossible to sufficiently ensure the line width of each first demarcation part, which exerts a great (dominant) influence on the wiring resistance of the antenna wire, thus posing a risk of increase in wiring resistance. In that respect, Example 1 makes it possible to efficiently lower the wiring resistance, as the line width W1 of each first demarcation part 26, which exerts a great (dominant) influence on the wiring resistance of the antenna wire 21, is greater than the line width W2 of each second demarcation part 27, which exerts a small (subordinate) influence on the wiring resistance of the antenna wire 21. Therefore, in Example 1, the wiring resistance can be made relatively lower if the opening ratio of the transparent antenna 17 is equal to the opening ratio of the transparent antenna of Comparative Example, and the opening ratio of the transparent antenna 17 can be made relatively higher if the wiring resistance is equal to the wiring resistance of Comparative Example. Thus, Example 1 makes it possible to sufficiently reduce the wiring resistance while sufficiently ensuring the opening ratio, i.e. light transmittance, of the transparent antenna 17.

As described above, a transparent antenna 17 according to the present embodiment includes an antenna wire 21, formed by a reticulated metal film in a shape of a ring, which generates a magnetic field on a center side thereof. The antenna wire 21 has a first extension part 23 extending along a direction of extension of the antenna wire 21 and a second extension part 24 extending along a direction intersecting with the direction of extension. The antenna wire 21 is configured such that a per unit length area of the first extension part 23 is larger than a per unit length area of the second extension part 24.

In this way, the flow of an electric current through the ring-shaped antenna wire 21 causes a magnetic field to be generated on the center side of the antenna wire 21 by an electromagnetic induction effect. The antenna wire 21 is formed by the reticulated metal film, which has reticulations ME through which light is transmitted, whereby the translucency of the transparent antenna 17 is secured. The wiring resistance of the antenna wire 21 tends to become lower as the opening area of the reticulations ME in the metal film becomes smaller and the area of the metal film becomes larger, and tends to become higher as the opening area of the reticulations ME in the metal film becomes larger and the area of the metal film becomes smaller. Note here that the influence on the wiring resistance of the per unit length area of the first extension part 23, of the antenna wire 21, which extends along the direction of extension of the antenna wire 21, is relatively greater than the influence on the wiring resistance of the per unit length area of the second extension part 24, of the antenna wire 21, which extends along a direction intersecting with the direction of extension.

Moreover, since the antenna wire 21 is configured such that the per unit length area of the first extension part 23, which extends along the direction of extension of the antenna wire 21, is larger than the per unit length area of the second extension part 24, which extends along a direction intersecting with the direction of extension, it is possible to efficiently lower the wiring resistance while sufficiently securing the opening area of the reticulations ME. This makes it possible to achieve a reduction in wiring resistance while achieving sufficient light transmittance.

Further, the antenna wire 21 has a plurality of reticulations ME and a plurality of demarcation parts 25 demarcating the reticulations ME, the demarcation parts 25 being each constituted by a first demarcation part 26 extending along the direction of extension and a second demarcation part 27 extending along a direction intersecting with the direction of extension, the first extension part 23 comprises a plurality of the first demarcation parts 26, and the second extension part 24 comprises a plurality of the second demarcation parts 27. In this way, the per unit length area of the first extension part 23 comprising the plurality of first demarcation parts 26 is larger than the per unit length area of the second extension part 24 comprising the plurality of second demarcation parts 27. This makes it possible to efficiently lower the wiring resistance while sufficiently securing the opening area of the reticulations ME. This in turn makes it possible to achieve a reduction in wiring resistance while achieving sufficient light transmittance.

Further, the first demarcation part 26 has a line width W1 that is greater than a line width W2 of the second demarcation part 27. In this way, by making the line width W1 of the first demarcation part 26 wider than the line width W2 of the second demarcation part 27, the per unit length area of the first extension part 23 comprising a plurality of the first demarcation parts 26 can be made larger than the per unit length area of the second extension part 24 comprising a plurality of the second demarcation parts 27.

Further, the antenna wire 21 has a planar shape forming a quadrangular ring and has a pair of short side parts (first side parts) 18S extending parallel to a first direction and a pair of long side parts (second side parts) 18L extending parallel to a second direction orthogonal to the first direction, the short side parts 18S are each configured such that the first demarcation part 26 extends along the first direction and the second demarcation part 27 extends along the second direction, and the long side parts 18L are each configured such that the first demarcation part 26 extends along the second direction and the second demarcation part 27 extends along the first direction. In this way, in each of the short side parts 18S, of the antenna wire 21 having a planar shape forming a quadrangular ring, which extend parallel to the first direction, the per unit length area of the first extension part 23 comprising a plurality of the first demarcation parts 26 extending along the first direction is larger than the per unit length area of the second extension part 24 comprising a plurality of the second demarcation parts 27 extending along the second direction orthogonal to the first direction. On the other hand, in each of the long side parts 18L, of the antenna wire 21, which extend parallel to the second direction, the per unit length area of the first extension part 23 comprising a plurality of the first demarcation parts 26 extending along the second direction is larger than the per unit length area of the second extension part 24 comprising a plurality of the second demarcation parts 27 extending along the first direction. This makes it possible to achieve a reduction in wiring resistance while achieving sufficient light transmittance.

Further, the antenna wire 21 has a planar shape forming a quadrangular ring and has a pair of short side parts 18S extending parallel to a first direction, a pair of long side parts 18L extending parallel to a second direction orthogonal to the first direction, and corner parts 18C connecting the short side parts 18S and the long side parts 18L, the short side parts 18S and the long side parts 18L each have the first extension part 23 and the second extension part 24, the corner parts 18C each have a corner-part first extension part 28 extending parallel to the first direction and a corner-part second extension part 29 extending parallel to the second direction, and the corner parts 18C are each configured such that the corner-part first extension part 28 and the corner-part second extension part 29 are equal in per unit length area to each other. In this way, since the short side parts 18S extend parallel to the first direction and the long side parts 18L extend parallel to the second direction orthogonal to the first direction, the per unit length area of the first extension part 23 in each of the short and long side parts 18S and 18L is larger than the per unit length area of the second extension part 24 in each of the short and long side parts 18S and 18L. This makes it possible to efficiently lower the wiring resistance while sufficiently securing the opening area of the reticulations ME in the short side parts 18S and the long side parts 18L. Meanwhile, since the corner parts 18C connect the short side parts 18S and the long side parts 18L, the corner-part first extension part 28 and the corner-part second extension part 29 are equal in per unit length area to each other. This makes it difficult for the short side parts 18S and the long side parts 18L to differ from each other in terms of the opening area of the reticulations ME and the wiring resistance.

Further, the corner parts 18C are each configured such that the per unit length area of the corner-part first extension part 28 is smaller than the per unit length area of the first extension part 23 constituting the short side parts 18S and the long side parts 18L and the per unit length area of the corner-part second extension part 29 is larger than the per unit length area of the second extension part 24 constituting the short side parts 18S and the long side parts 18L. In this way, the per unit length areas of the corner-part first and second extension parts 28 and 29 constituting the corner part 18C are appropriate. This makes it more difficult for the short side parts 18S and the long side parts 18L to differ from each other in terms of the opening area of the reticulations ME and the wiring resistance.

Further, a lead wiring part 19 extending in such a form as to lead from the antenna wire 21 is further included, the lead wiring part 19 has a first lead extension part 32 extending along a direction of extension of the lead wiring part 19 and a second lead extension part 33 extending along a direction intersecting with the direction of extension of the lead wiring part 19, and the lead wiring part 19 is configured such that a per unit length area of the first lead extension part 32 is larger than a per unit length area of the second lead extension part 33. In this way, the flow of an electric current through the ring-shaped antenna wire 21 due to the passage of electricity through the lead wiring part 19 causes a magnetic field to be generated on the center side of the antenna wire 21 by an electromagnetic induction effect. This lead wiring part 19 is configured such that the per unit length area of the first lead extension part 32 extending along the direction of extension of the lead wiring part 19 is larger than the per unit length area of the second lead extension part 33 extending along a direction intersecting with the direction of extension of the lead wiring part 19. This makes it possible to efficiently lower the wiring resistance while sufficiently securing the opening area of the reticulations ME. This in turn makes it possible to achieve a reduction in wiring resistance while achieving sufficient light transmittance.

Further, a liquid crystal display device (transparent antenna-equipped display device) 10 according to the present embodiment includes: the transparent antenna 17 described above; a transparent antenna substrate 12 provided with the transparent antenna 17; and a liquid crystal panel (display panel) 11, stacked on the transparent antenna substrate 12, which has a display region AA that is capable of displaying an image and a non-display region NAA surrounding the display region AA. The transparent antenna 17 is placed in a position overlapping the display region AA.

In this way, the use of the transparent antenna 17 placed in a position overlapping the display region AA of the liquid crystal panel 11 makes it possible to perform communication, for example, with an external device or the like. This makes it possible to perform an operation such as bringing the external device closer to the transparent antenna 17 in accordance with an image displayed on the display region AA, thus offering great convenience. Moreover, the antenna performance of the transparent antenna 17 is so high that communication with the external device or the like can be satisfactorily performed.

Embodiment 2

Embodiment 2 of the present invention is described with reference to FIGS. 11 to 13. Embodiment 2 illustrates a different arrangement of demarcation parts 126 and 127 in each side part 118L or 118S. It should be noted that a repeated description of structures, actions, and effects which are similar to those of Embodiment 1 described above is omitted.

Figure 11:
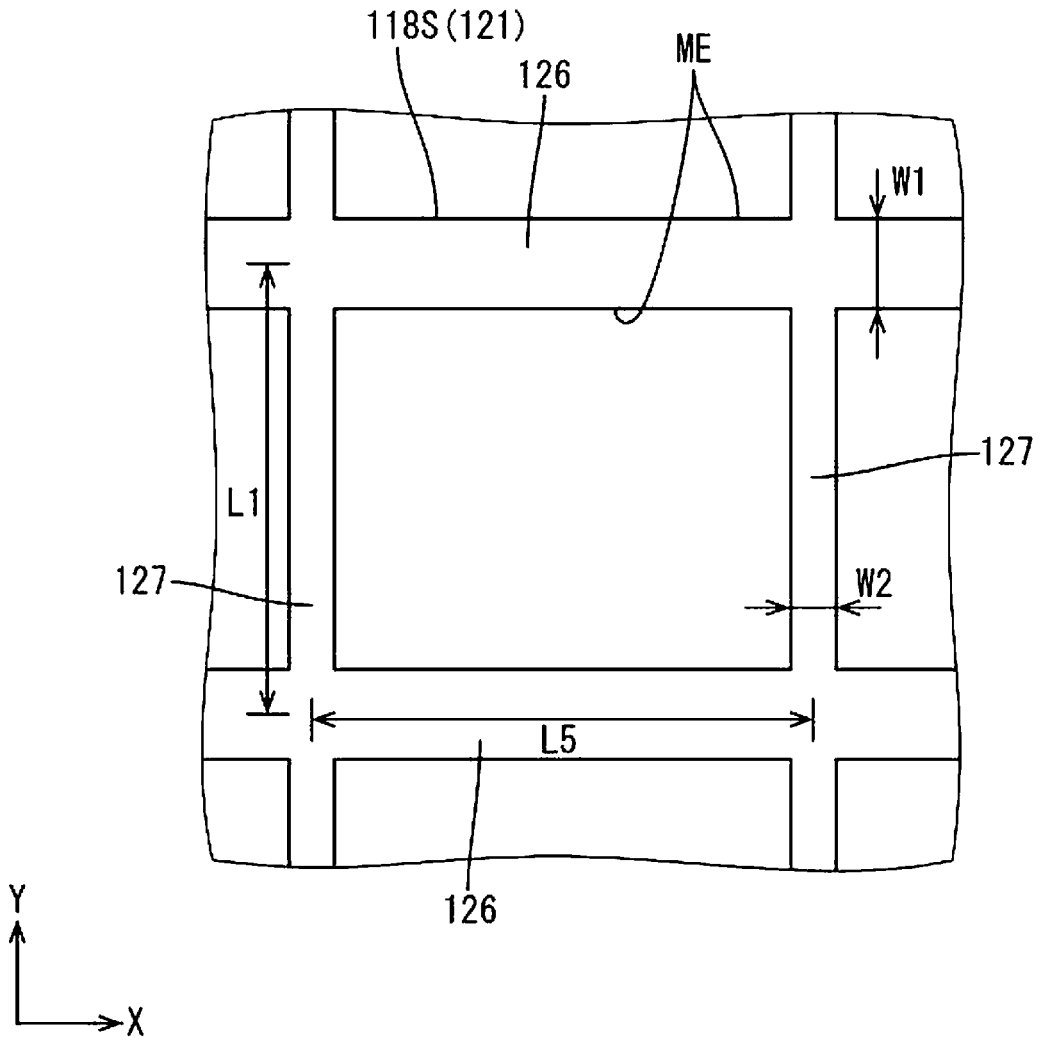
FIG. 11 is a plan view of demarcation parts in a short side part of an antenna wire according to Embodiment 2 of the present invention.
Figure 12:
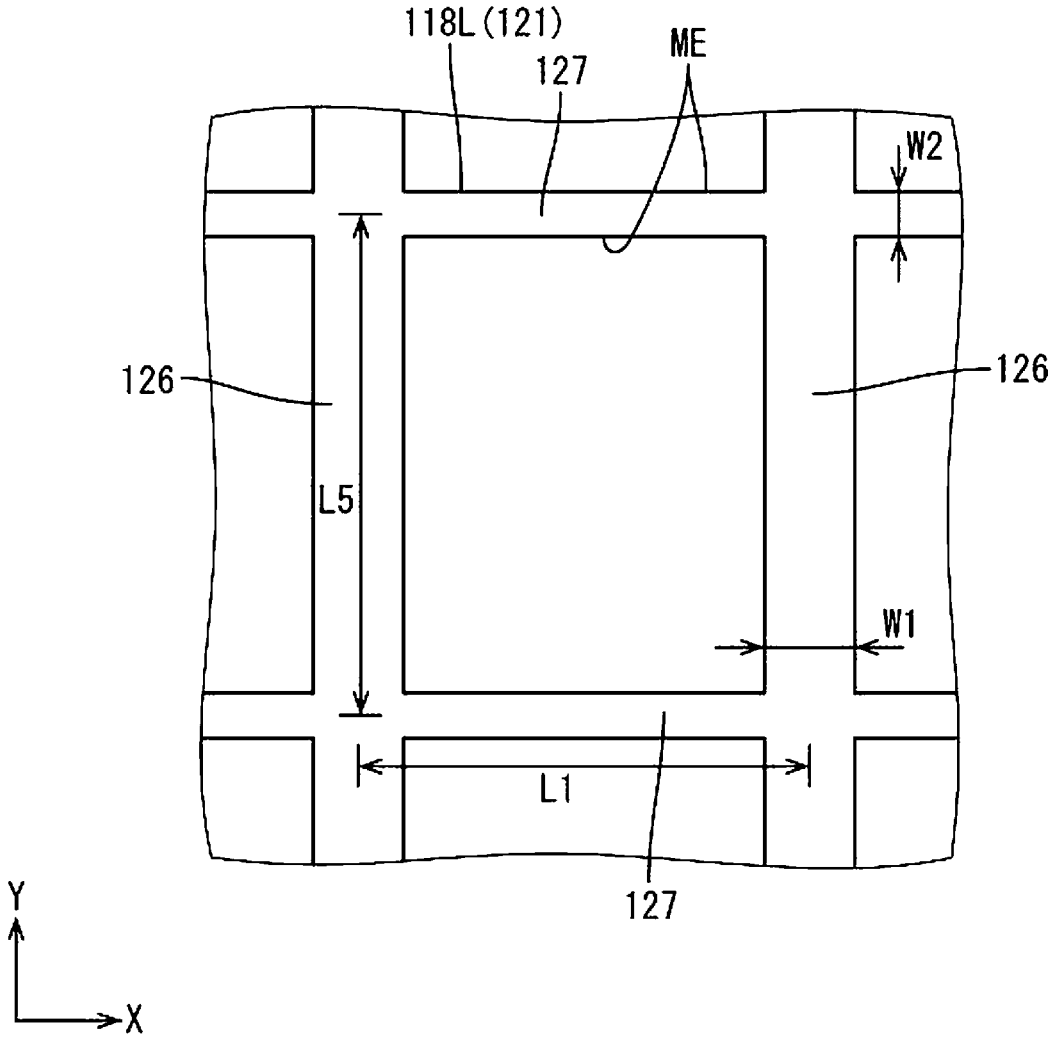
FIG. 12 is a plan view of demarcation parts in a long side part of the antenna wire.

As shown in FIGS. 11 and 12, an antenna wire 121 according to the present embodiment is configured such that, in the demarcation parts 126 and 127 constituting the side parts 118L and 118S, the spacing L5 between adjacent second demarcation parts 127 with a reticulation ME interposed therebetween (i.e. the length of each of the first demarcation parts 126) is wider (greater) than the spacing L1 between adjacent first demarcation parts 126 with a reticulation ME interposed therebetween (i.e. the length of each of the second demarcation parts 127). Therefore, whereas a reticulation ME defined by demarcation parts 126 and 127 in each of the short side parts 118S has a horizontally long quadrangular shape (FIG. 11), a reticulation ME defined by demarcation parts 126 and 127 in each of the long side parts 118L has a vertically long quadrangular shape (FIG. 12). This allows the opening area of the reticulations ME to be larger by the expansion (L5−L1) of the spacing L5 between adjacent second demarcation parts 127 with a reticulation ME interposed therebetween than in Embodiment 1 described above. This allows the transparent antenna to have a higher opening ratio. Moreover, the opening area of the reticulations ME can be ensured as usual, for example, by adjusting the spacing L5 between adjacent second demarcation parts 127 with a reticulation ME interposed therebetween to take on such a value as to compensate for a decrease in the opening area of the reticulations ME attributed to the difference between the line width W1 of each of the first demarcation parts 126 and the line width W2 of each of the second demarcation parts 127.

The following describes Comparative Experiment 2, which was conducted to find out how the opening ratio of the transparent antenna thus configured varies according to the line width of each of the demarcation parts 126 and 127. In addition to Comparative Example and Example 1 of Comparative Experiment 1 described above, Comparative Experiment 2 used Example 2, which is a transparent antenna configured such that the spacing L5 between adjacent second demarcation parts 127 with a reticulation ME interposed therebetween is wider than the spacing L1 between adjacent first demarcation parts 126 with a reticulation ME interposed therebetween, i.e. a transparent antenna described in the preceding paragraphs. In Comparative Experiment 2, the spacing L1 between adjacent first demarcation parts 126 with a reticulation ME interposed therebetween in Example 2 is equal to the spacings between adjacent first demarcation parts with a reticulation interposed therebetween and the spacings between adjacent second demarcation parts with a reticulation interposed therebetween in Comparative Example and Example 1. FIG. 13 shows the results of calculation of the opening ratio of each of the transparent antennas of Comparative Example and Examples 1 and 2 with varying line widths of each demarcation part.

Figure 13:
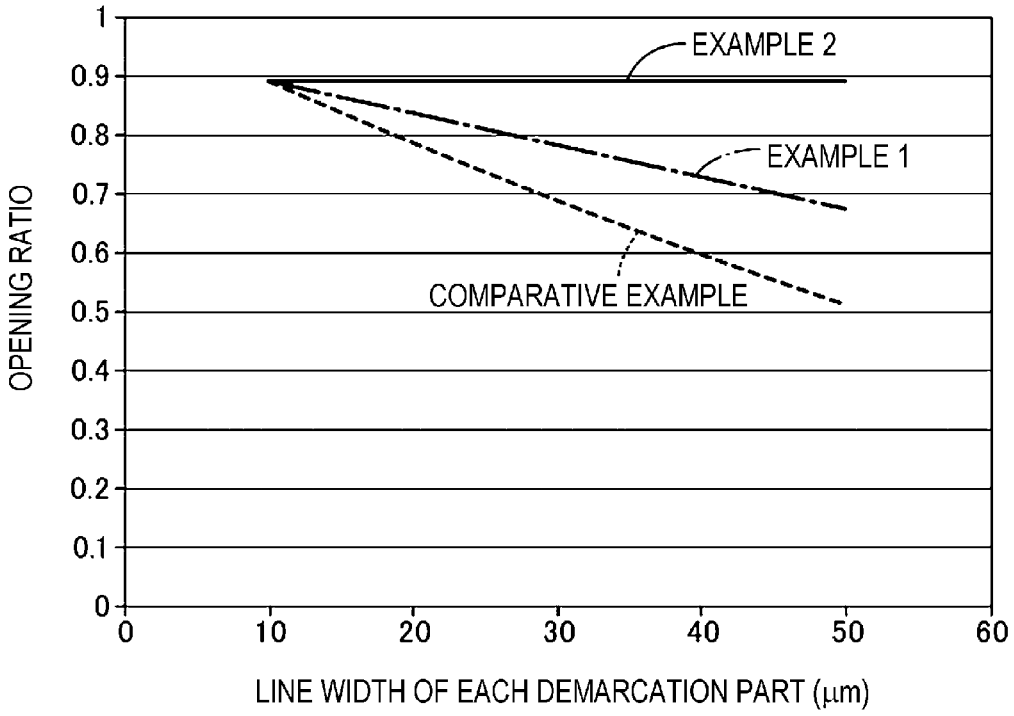
FIG. 13 is a graph showing a relationship between the opening ratios of transparent antennas of Comparative Example and Examples 1 and 2 and the line width of each demarcation part in Comparative Experiment 2.

In FIG. 13, the horizontal axis represents the line width of each demarcation part (in units of "μm"), and the vertical axis represents the opening ratio of each of the transparent antennas (no unit of quantity required), as in FIG. 10 of Comparative Experiment 1. It should be noted that, in terms of Example 2, the horizontal axis of FIG. 13 represents the line width W1 of each first demarcation part 126. In FIG. 13, the solid line graph represents the experimental result of Example 2, the dashed-dotted line graph represents the experimental result of Example 1, and the dotted line graph represents the experimental result of Comparative Example. The opening ratio of the transparent antenna of Example 2 was calculated as follows: The opening ratio of the transparent antenna was calculated from formula "(L1−W1)(L5−W2)/L1·L2", where "L1" is the spacing between adjacent first demarcation parts 126 with a reticulation ME interposed therebetween, "L2" is the spacing between adjacent second demarcation parts 127 with a reticulation ME interposed therebetween, "W1" is the line width of each first demarcation part 126, and "W2" is the line width of each second demarcation part 127. It should be noted that, in Comparative Experiment 2, formulas "W1=Wref>W2" and "L5>L1=Lref" hold.

Here are the experimental results of Comparative Experiment 2. According to FIG. 13, the opening ratio of the transparent antenna of Example 2 is held substantially constant even with increase in line width W1 or W2 of each demarcation part 126 or 127. Therefore, the difference in opening ratio between the transparent antenna of Example 2 and the transparent antennas of Example 1 and Comparative Example tends to become greater with increase in line width W1 or W2 of each demarcation part 126 or 127. In Example 2, since the spacing L5 between adjacent second demarcation parts 127 with a reticulation ME interposed therebetween is wider than the spacing L1 between adjacent first demarcation parts 126 with a reticulation ME interposed therebetween, the opening ratio of the transparent antenna is higher by the difference between the spacings L1 and L5. Moreover, it is preferable that the spacing L5 between adjacent second demarcation parts 127 with a reticulation ME interposed therebetween be set by being calculated from formula "W2/(1−AR·L1/(L1−W1)), where "AR" is the target value of the opening ratio of the transparent antenna. Doing so makes it possible to hold the opening ratio of the transparent antenna constant regardless of whether the line widths W1 and W2 of the demarcation parts 126 and 127 are large or small, as indicated by the solid line graph in FIG. 13. All this makes it possible to ensure the opening ratio, i.e. light transmittance, of the transparent antenna as usual while keeping the wiring resistance sufficiently low.

According to the present embodiment, as described above, the spacing L5 between adjacent second demarcation parts 127 is wider than the spacing L1 between adjacent first demarcation parts 126. In this way, by making the spacing L5 between adjacent second demarcation parts 127 wider than the spacing L1 between adjacent first demarcation parts 126, the opening area of the reticulations ME can be expanded. This makes it possible to suitably achieve a reduction in wiring resistance by making the line width W1 of each of the first demarcation parts 126 relatively wider and to, by making the spacing L5 between adjacent second demarcation parts 127 relatively wider, ensure the opening area of the reticulation ME as usual while maintaining the wiring resistance.

Embodiment 3

Embodiment 3 of the present invention is described with reference to FIGS. 14 to 16. Embodiment 3 illustrates a different line width and arrangement of demarcation parts 226 and 227 in each side part 218L or 218S from Embodiment 1 described above. It should be noted that a repeated description of structures, actions, and effects which are similar to those of Embodiment 1 described above is omitted.

Figure 14:
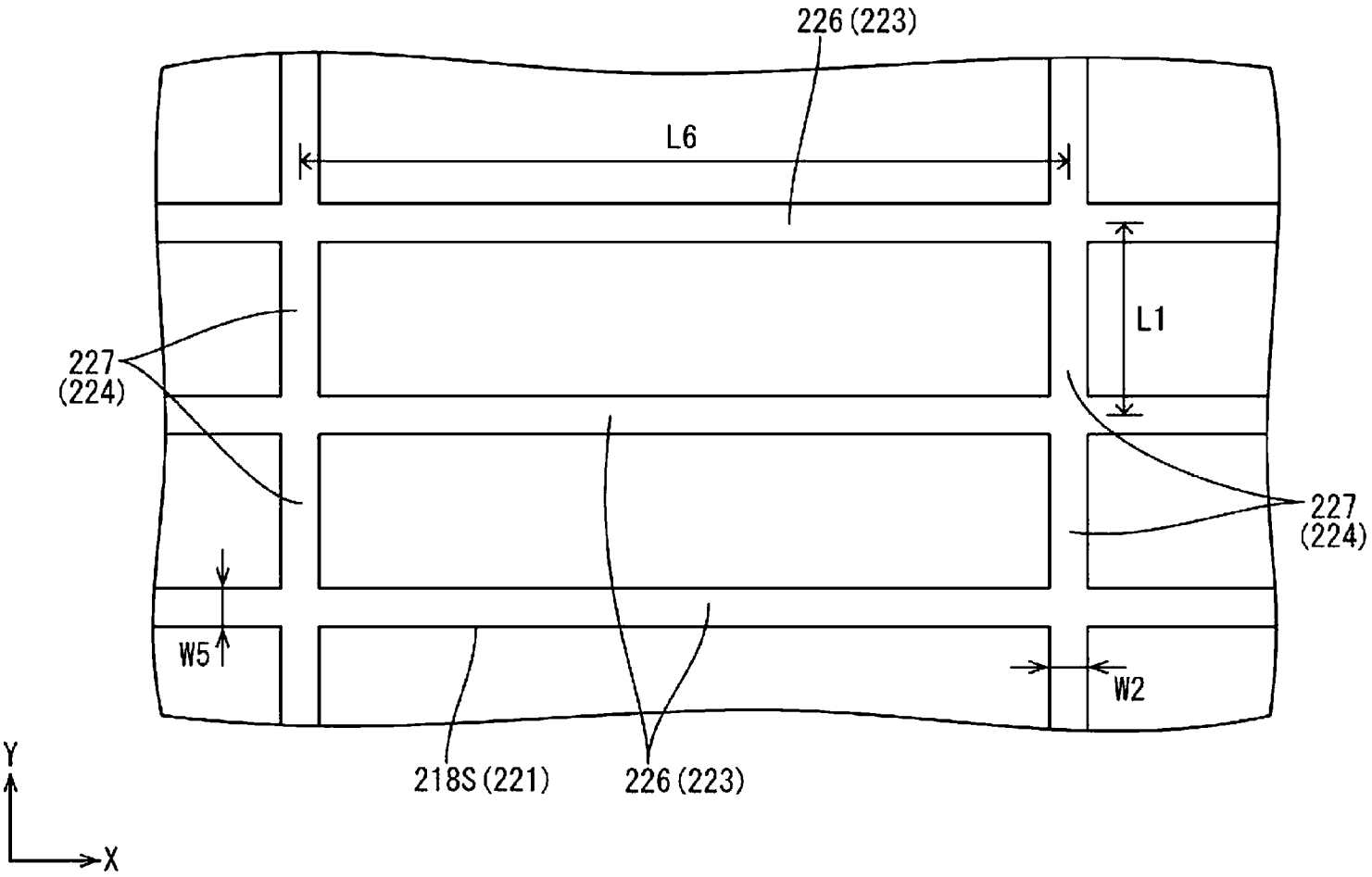
FIG. 14 is a plan view of demarcation parts in a short side part of an antenna wire according to Embodiment 3 of the present invention.
Figure 15:
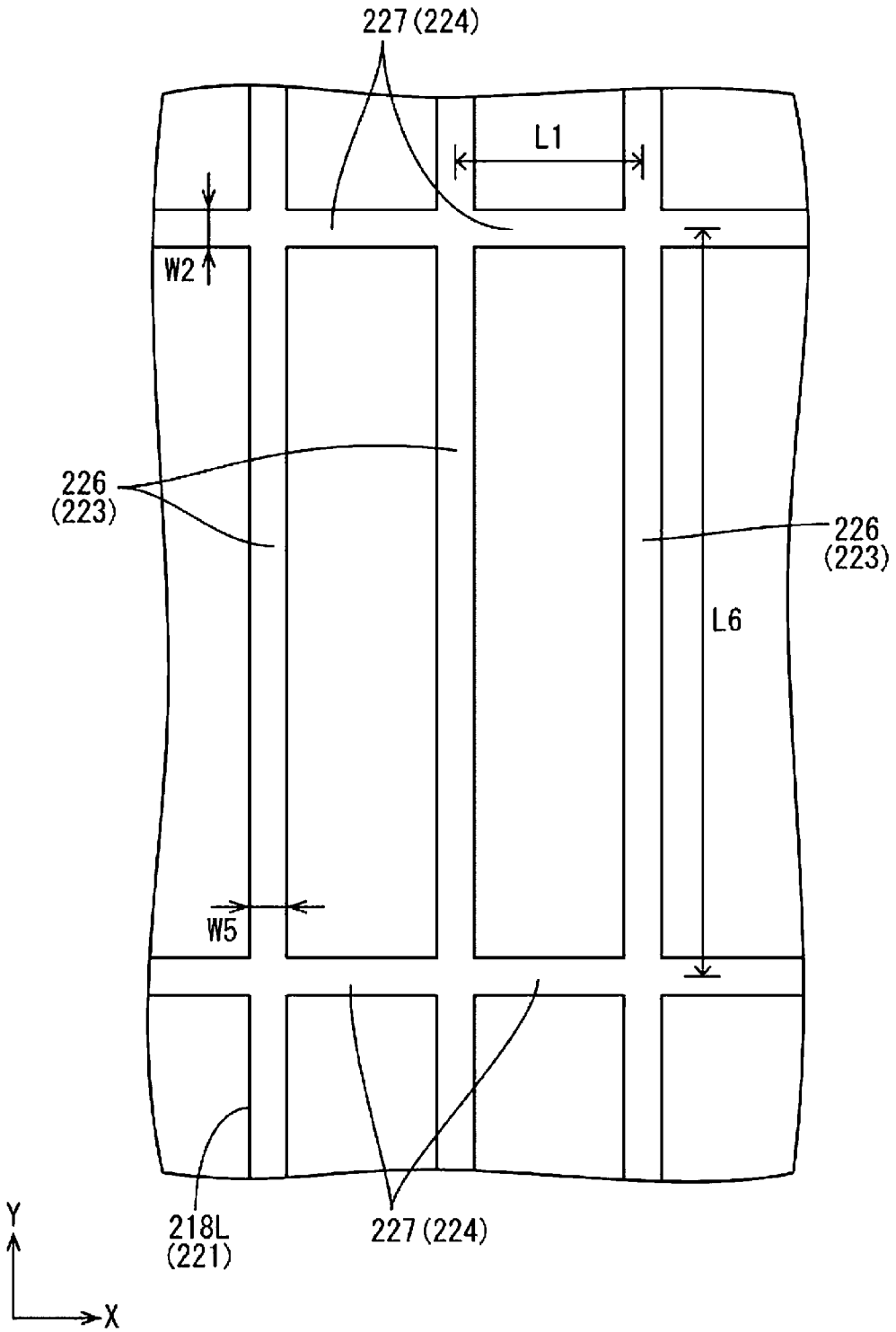
FIG. 15 is a plan view of demarcation parts in a long side part of the antenna wire.

As shown in FIGS. 14 and 15, an antenna wire 221 according to the present embodiment is configured such that, in the demarcation parts 226 and 227 constituting the side parts 218L and 218S, the line width W5 of each of the first demarcation parts 226 is equal to the line width W2 of each of the second demarcation parts 227 and the spacing L6 between adjacent second demarcation parts 227 with a reticulation ME interposed therebetween (i.e. the length of each of the first demarcation parts 226) is wider (longer) than the spacing L1 between adjacent first demarcation parts 226 with a reticulation ME interposed therebetween (i.e. the length of each of the second demarcation parts 227). Therefore, whereas a reticulation ME defined by demarcation parts 226 and 227 in each of the short side parts 218S has a horizontally long quadrangular shape (FIG. 14), a reticulation ME defined by demarcation parts 226 and 227 in each of the long side parts 218L has a vertically long quadrangular shape (FIG. 15). In other words, since the spacing L1 between adjacent first demarcation parts 226 with a reticulation ME interposed therebetween is narrower than the spacing L6 between adjacent second demarcation parts 227 with a reticulation ME interposed therebetween, the number of first demarcation parts 226 that are had by a first extension part 223 is larger than the number of second demarcation parts 227 that are had by a second extension part 224. This allows the per unit length area of the first extension part 223 comprising the plurality of first demarcation parts 226 to be larger than the per unit length area of the second extension part 224 comprising the plurality of second demarcation parts 227. It is preferable that when the spacing L1 between adjacent first demarcation parts 226 with a reticulation ME interposed therebetween is expressed by formula "Lref/a" (where "a" is a variable of 1 or larger), the spacing L6 between adjacent second demarcation parts 227 with a reticulation ME interposed therebetween be calculated according to formula "a·Lref", where "Lref" is the reference spacing. The variable "a" is hereinafter referred to as "ratio variable" for convenience.

The following describes Comparative Experiment 3, which was conducted to find out how the opening ratio of the transparent antenna thus configured varies according to the ratio variable a of the spacings L1 and L6 between demarcation parts 226 and between demarcation parts 227. Comparative Experiment 3 used Comparative Example of Comparative Experiment 1 described above and Example 3, which is a transparent antenna configured such that the line width W5 of each of the first demarcation parts 226 is equal to the line width W2 of each of the second demarcation parts 227 and the spacing L6 between adjacent second demarcation parts 227 with a reticulation ME interposed therebetween is wider than the spacing L1 between adjacent first demarcation parts 226 with a reticulation ME interposed therebetween, i.e. a transparent antenna described in the preceding paragraphs. In Comparative Experiment 3, whereas the spacings between demarcation parts in Comparative Example both take on values calculated according to formula "Lref/a", the spacing L1 between adjacent first demarcation parts 226 with a reticulation ME interposed therebetween in Example 3 takes on a value calculated according to formula "Lref/a" and the spacing L6 between adjacent second demarcation parts 227 with a reticulation ME interposed therebetween in Example 3 takes on a value calculated according to formula "a·Lref". FIG. 16 shows the results of calculation of the opening ratio of each of the transparent antennas of Comparative Example and Example 3 with variations of this ratio variable a. It should be noted that the spacing L1 between adjacent first demarcation parts 226 with a reticulation ME interposed therebetween in Example 3 is equal to the spacing between adjacent first demarcation parts with a reticulation interposed therebetween and the spacing between adjacent second demarcation parts with a reticulation interposed therebetween in Comparative Example. Further, the line widths W2 and W5 of the demarcation parts 226 and 227 of Example 3 are equal to the line width of each of the demarcation parts of Comparative Example.

Figure 16:
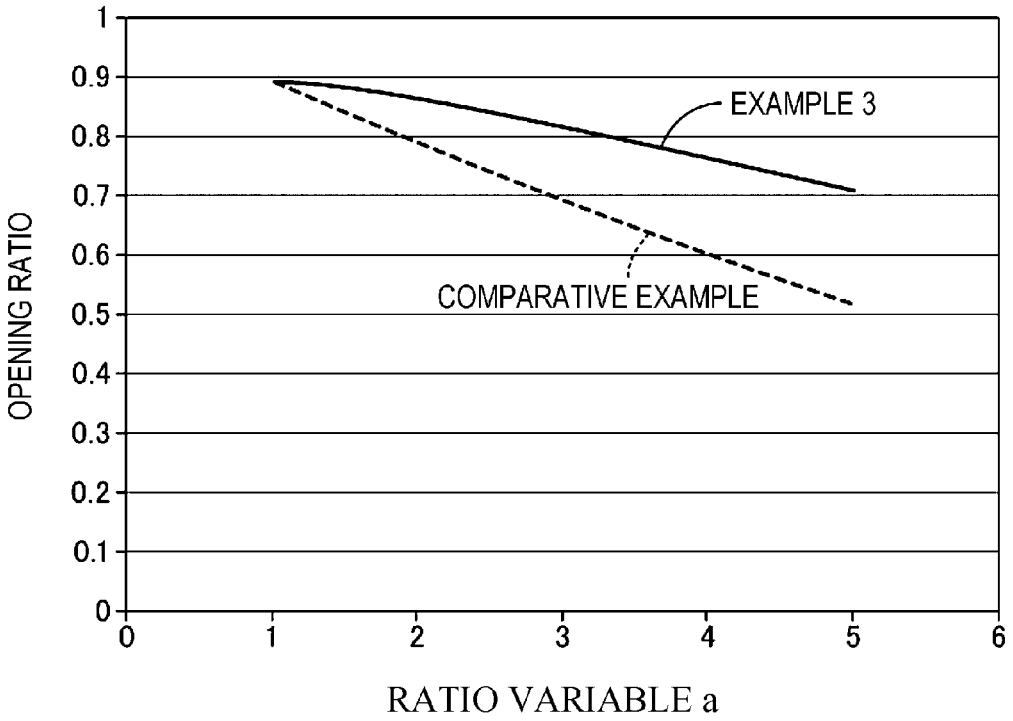
FIG. 16 is a graph showing a relationship between the opening ratios of transparent antennas of Comparative Example and Example 3 and a ratio variable a in Comparative Experiment 3.

In FIG. 16, the horizontal axis represents the ratio variable a (no unit of quantity required), and the vertical axis represents the opening ratio of each of the transparent antennas (no unit of quantity required). In FIG. 16, the graphs of Comparative Example and Example 3 are identical in wiring resistance at the same position on the horizontal axis. In FIG. 16, the wiring resistance tends to become lower rightward on the horizontal axis (as the ratio variable a becomes larger), and on the other hand, the wiring resistance tends to become higher leftward on the horizontal axis (as the ratio variable a becomes smaller). In FIG. 16, the solid line graph represents the experimental result of Example 3, and the dashed line graph represents the experimental result of Comparative Example. The opening ratio of the transparent antenna of Example 3 was calculated as follows: the opening ratio of the transparent antenna was calculated from formula "(L1−W5)(L6−W2)/L1·L6", where "L1" is the spacing between adjacent first demarcation parts 226 with a reticulation ME interposed therebetween, "L6" is the spacing between adjacent second demarcation parts 227 with a reticulation ME interposed therebetween, "W5" is the line width of each first demarcation part 226, and "W2" is the line width of each second demarcation part 227. It should be noted that, in Comparative Experiment 3, formulas "W5=W2=Wref" and "L6=a·Lref>L1=Lref/a" hold.

Here are the experimental results of Comparative Experiment 3. According to FIG. 16, the opening ratio of each of the transparent antennas of Comparative Example and Example 3 tend to become gradually lower with increase in ratio variable a. Moreover, Example 3 is gentler in slope of the graph and slower in decrease of the opening ratio of the transparent antenna entailed by an increase in ratio variable a than Comparative Example. Therefore, the difference in opening ratio between the transparent antennas of Example 3 and Comparative Example tends to become greater in proportion to the magnitude of the ratio variable a. In Example 3, since the spacing L6 between adjacent second demarcation parts 227 with a reticulation ME interposed therebetween is wider than the spacing L1 between adjacent first demarcation parts 226 with a reticulation ME interposed therebetween, the opening ratio of the transparent antenna is higher by the difference between the spacings L1 and L6, although the line widths W2 and W5 of the demarcation parts 226 and 227 are equal. In Comparative Example, on the other hand, it is conceivable that the same opening ratio may be achieved, for example, by reducing the ratio variable a to widen the spacings between demarcation parts. However, doing so makes it impossible to sufficiently ensure the number of first demarcation parts, which exerts a great (dominant) influence on the wiring resistance of the antenna wire, thus posing a risk of increase in wiring resistance. In that respect, Example 3 makes it possible to efficiently lower the wiring resistance, as the spacing L1 between first demarcation parts 226, which exerts a great (dominant) influence on the wiring resistance of the antenna wire 221, is narrower than the spacing L6 between second demarcation parts 227, which exerts a small (subordinate) influence on the wiring resistance of the antenna wire 221, and the number of first demarcation parts 226 that the first extension part 223 has is larger than the number of second demarcation parts 227 that the second extension part 224 has. Therefore, in Example 3, the wiring resistance can be made relatively lower if the opening ratio of the transparent antenna is equal to the opening ratio of the transparent antenna of Comparative Example, and the opening ratio of the transparent antenna can be made relatively higher if the wiring resistance is equal to the wiring resistance of Comparative Example. Thus, Example 3 makes it possible to sufficiently reduce the wiring resistance while sufficiently ensuring the opening ratio, i.e. light transmittance, of the transparent antenna.

According to the present embodiment, as described above, the spacing L1 between adjacent first demarcation parts 226 is narrower than the spacing L6 between adjacent second demarcation parts 227. In this way, by making the spacing L1 between adjacent first demarcation parts 226 narrower than the spacing L6 between adjacent second demarcation parts 227, the number of first demarcation parts 226 provided is made larger than the number of second demarcation parts 227 provided. This allows the per unit length area of the first extension part 223 comprising the plurality of first demarcation parts 226 to be larger than the per unit length area of the second extension part 224 comprising the plurality of second demarcation parts 227.

Embodiment 4

Embodiment 4 of the present invention is described with reference to FIGS. 17 to 19. Embodiment 4 illustrates a different arrangement of demarcation parts 326 and 327 in each side part 318L or 318S from Embodiment 3 described above. It should be noted that a repeated description of structures, actions, and effects which are similar to those of Embodiment 3 described above is omitted.

Figure 17:
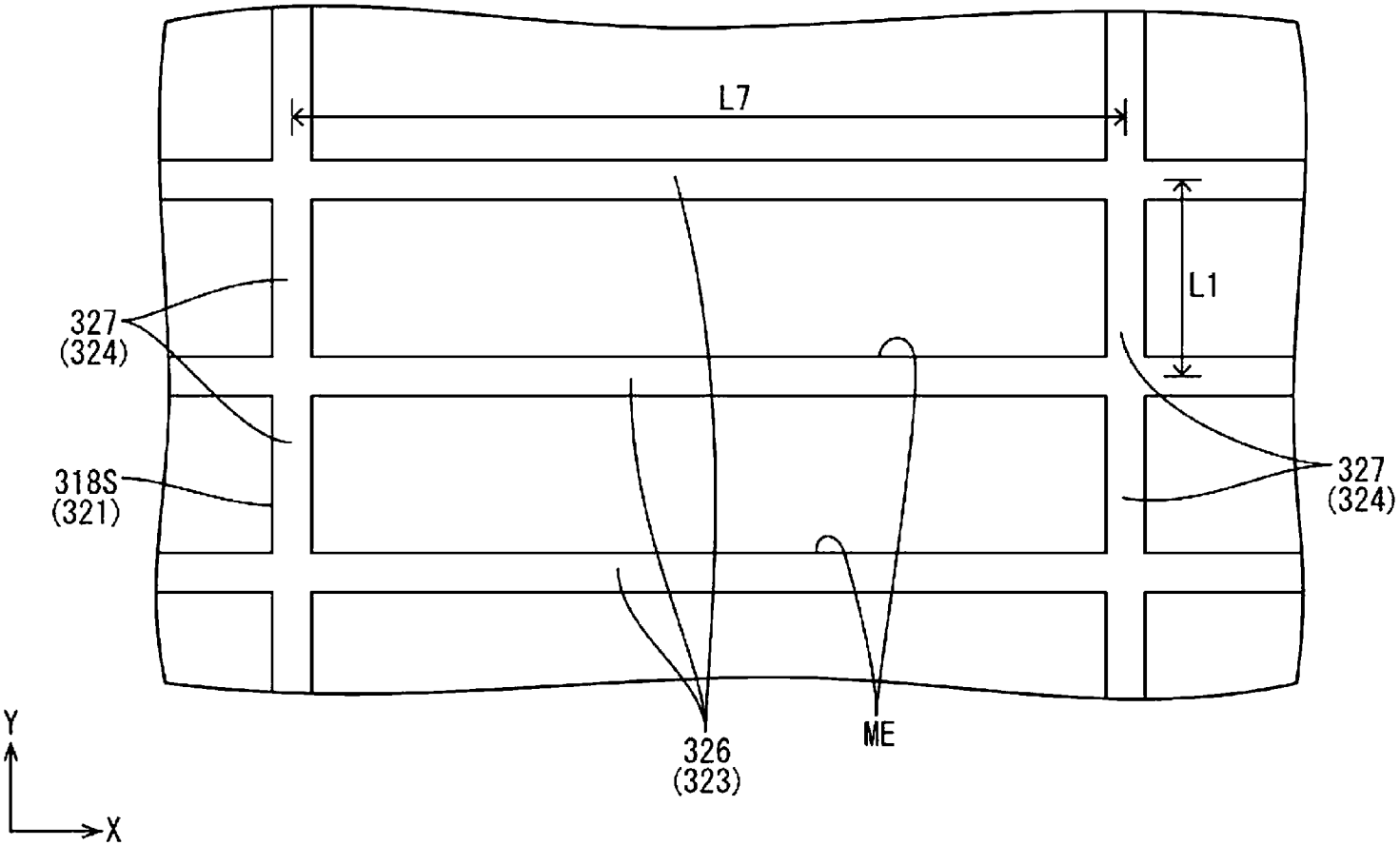
FIG. 17 is a plan view of demarcation parts in a short side part of an antenna wire according to Embodiment 4 of the present invention.
Figure 18:
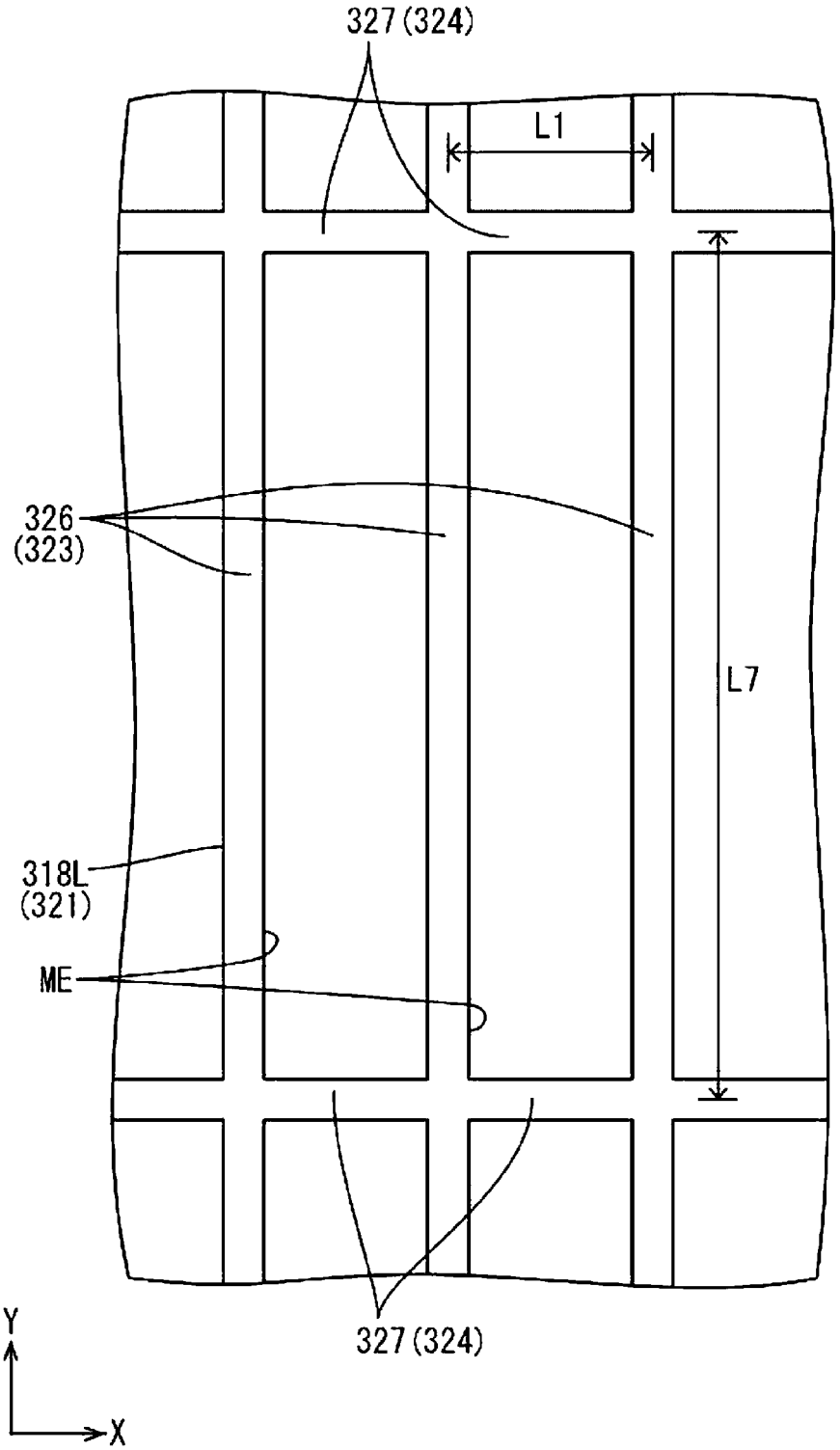
FIG. 18 is a plan view of demarcation parts in a long side part of the antenna wire.

As shown in FIGS. 17 and 18, an antenna wire 321 according to the present embodiment is configured such that, in the demarcation parts 326 and 327 constituting the side parts 318L and 318S, the spacing L7 between adjacent second demarcation parts 327 with a reticulation ME interposed therebetween is defined by a ratio variable b that is different from the ratio variable a defining the spacing L1 between adjacent first demarcation parts 326 with a reticulation ME interposed therebetween. It is preferable that when the spacing L1 between adjacent first demarcation parts 326 with a reticulation ME interposed therebetween is expressed by formula "Lref/a", the spacing L7 between adjacent second demarcation parts 327 with a reticulation ME interposed therebetween be calculated according to formula "b·Lref" (where "b" is a variable of 1 or larger that is larger than "a"), where "Lref" is the reference spacing. Therefore, the spacing L7 between adjacent second demarcation parts 327 with a reticulation ME interposed therebetween is further greater than the spacing L6 between adjacent second demarcation parts 227 with a reticulation ME interposed therebetween in Example 3 described above. Specifically, the ratio variable b, which defines the spacing L7 between adjacent second demarcation parts 327 with a reticulation ME interposed therebetween, needs only be calculated according to formula (1) or (2) below (where "AR" is the target value of the opening ratio of the transparent antenna). That is, the ratio variable b is a variable that depends on the ratio variable a. This allows the opening area of the reticulations ME to be larger by the expansion (L7−L1) of the spacing L7 between adjacent second demarcation parts 327 with a reticulation ME interposed therebetween than in Embodiment 3 described above. This allows the transparent antenna to have a higher opening ratio. Moreover, the opening area of the reticulations ME can be ensured as usual, for example, by adjusting the spacing L7 between adjacent second demarcation parts 327 with a reticulation ME interposed therebetween to take on such a value as to compensate for a decrease in the opening area of the reticulations ME attributed to an increase in value of the ratio variable a, which defines the spacing L1 between adjacent first demarcation parts 326 with a reticulation ME interposed therebetween.

[Math. 1]

$$b = \frac{W5}{\left(1 - \frac{AR \cdot Lref/a}{Lref - W5}\right) \cdot Lref} \tag{1}$$

[Math. 2]

$$b = \frac{W5(Lref/a - W5)}{Lref \cdot (Lref/a - W5 - Lref \cdot AR/a)} \tag{2}$$

The following describes Comparative Experiment 4, which was conducted to find out how the opening ratio of the transparent antenna thus configured varies according to the ratio variables a and b of the spacings L1 and L7 between demarcation parts 326 and between demarcation parts 327. In addition to Comparative Example and Example 3 of Comparative Experiment 3 described above, Comparative Experiment 4 uses Example 4, which is a transparent antenna configured such that the spacing L7 between adjacent second demarcation parts 327 with a reticulation ME interposed therebetween is defined by the ratio variable b that is larger than the ratio variable a defining the spacing L1 between adjacent first demarcation parts 326 with a reticulation ME interposed therebetween, i.e. a transparent antenna described in the preceding paragraphs. In Comparative Experiment 4, the spacing L1 between adjacent first demarcation parts 326 with a reticulation ME interposed therebetween in Example 4 takes on a value calculated according to formula "Lref/a" and the spacing L7 between adjacent second demarcation parts 327 with a reticulation ME interposed therebetween in Example 4 takes on a value calculated according to formula "b·Lref". FIG. 19 shows the results of calculation of the opening ratio of each of the transparent antennas of Comparative Example and Example 4 with variations of this ratio variable a. It should be noted that the spacing L1 between adjacent first demarcation parts 326 with a reticulation ME interposed therebetween in Example 4 is equal to the spacing between adjacent first demarcation parts with a reticulation interposed therebetween and the spacing between adjacent second demarcation parts with a reticulation interposed therebetween in Comparative Example. Further, the line widths W2 and W5 of the demarcation parts 326 and 327 of Example 4 are equal to the line width of each of the demarcation parts of Comparative Example.

Figure 19:
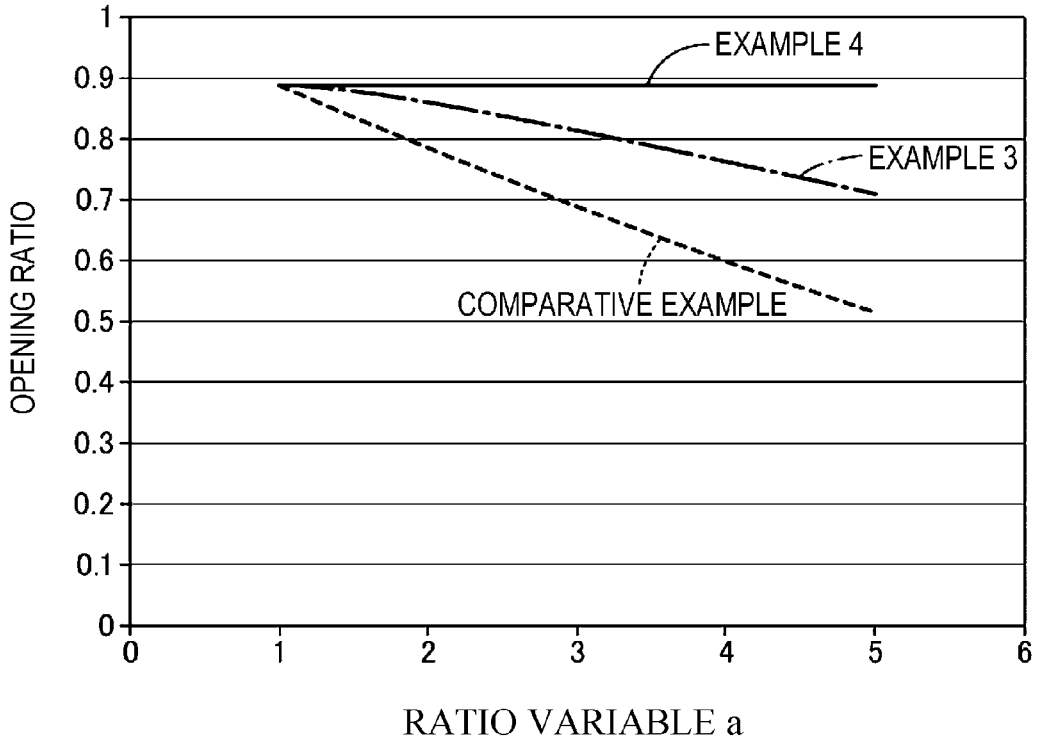
FIG. 19 is a graph showing a relationship between the opening ratios of transparent antennas of Comparative Example and Examples 3 and 4 and a ratio variable a in Comparative Experiment 4.

In FIG. 19, the horizontal axis represents the ratio variable a (no unit of quantity required), and the vertical axis represents the opening ratio of each of the transparent antennas (no unit of quantity required), as in FIG. 16 of Comparative Experiment 3. In FIG. 19, the solid line graph represents the experimental result of Example 4, the dashed-dotted line graph represents the experimental result of Example 3, and the dotted line graph represents the experimental result of Comparative Example. The opening ratio of the transparent antenna of Example 4 was calculated as follows: The opening ratio of the transparent antenna was calculated from formula "(L1−W5)(L7−W2)/L1·L7", where "L1" is the spacing between adjacent first demarcation parts 326 with a reticulation ME interposed therebetween, "L7" is the spacing between adjacent second demarcation parts 327 with a reticulation ME interposed therebetween, "W5" is the line width of each first demarcation part 326, and "W2" is the line width of each second demarcation part 327. It should be noted that, in Comparative Experiment 4, formulas "W5=W2=Wref", "L7=b·Lref>L1=Lref/a", and "b>a" hold.

Here are the experimental results of Comparative Experiment 4. According to FIG. 19, the opening ratio of the transparent antenna of Example 4 is held substantially constant even with increase in ratio variable a. Therefore, the difference in opening ratio between the transparent antennas of Example 4 and the transparent antennas of Example 3 and Comparative Example tends to become greater with increase in ratio variable a. In Example 4, since the spacing L7 between adjacent second demarcation parts 327 with a reticulation ME interposed therebetween is wider than the spacing L1 between adjacent first demarcation parts 326 with a reticulation ME interposed therebetween, the opening ratio of the transparent antenna is higher by the difference between the spacings L1 and L7. Moreover, it is preferable that the spacing L7 between adjacent second demarcation parts 327 with a reticulation ME interposed therebetween be set by using, as the ratio variable b, a value calculated from formula (1) or (2) above. Doing so makes it possible to hold the opening ratio of the transparent antenna constant regardless of whether the ratio variable a is large or small, as indicated by the solid line graph in FIG. 19. All this makes it possible to ensure the opening ratio, i.e. light transmittance, of the transparent antenna as usual while keeping the wiring resistance sufficiently low.

According to the present embodiment, as described above, the spacing L1 between adjacent first demarcation parts 326 is narrower than the spacing L7 between adjacent second demarcation parts 327. In this way, by making the spacing L1 between adjacent first demarcation parts 326 narrower than the spacing L7 between adjacent second demarcation parts 327, the number of first demarcation parts 326 provided is made larger than the number of second demarcation parts 327 provided. This allows the per unit length area of the first extension part 323 comprising the plurality of first demarcation parts 326 to be larger than the per unit length area of the second extension part 324 comprising the plurality of second demarcation parts 327. Moreover, by appropriately adjusting the spacing L7 between adjacent second demarcation parts 327, it is made possible to ensure the opening area of the reticulations ME as usual while maintaining the wiring resistance.

Embodiment 5

Embodiment 5 of the present invention is described with reference to FIG. 20 or 21. Embodiment 5 illustrates different planar shapes of reticulations ME and demarcation parts 425 from Embodiment 3 described above. It should be noted that a repeated description of structures, actions, and effects which are similar to those of Embodiment 3 described above is omitted.

Figure 20:
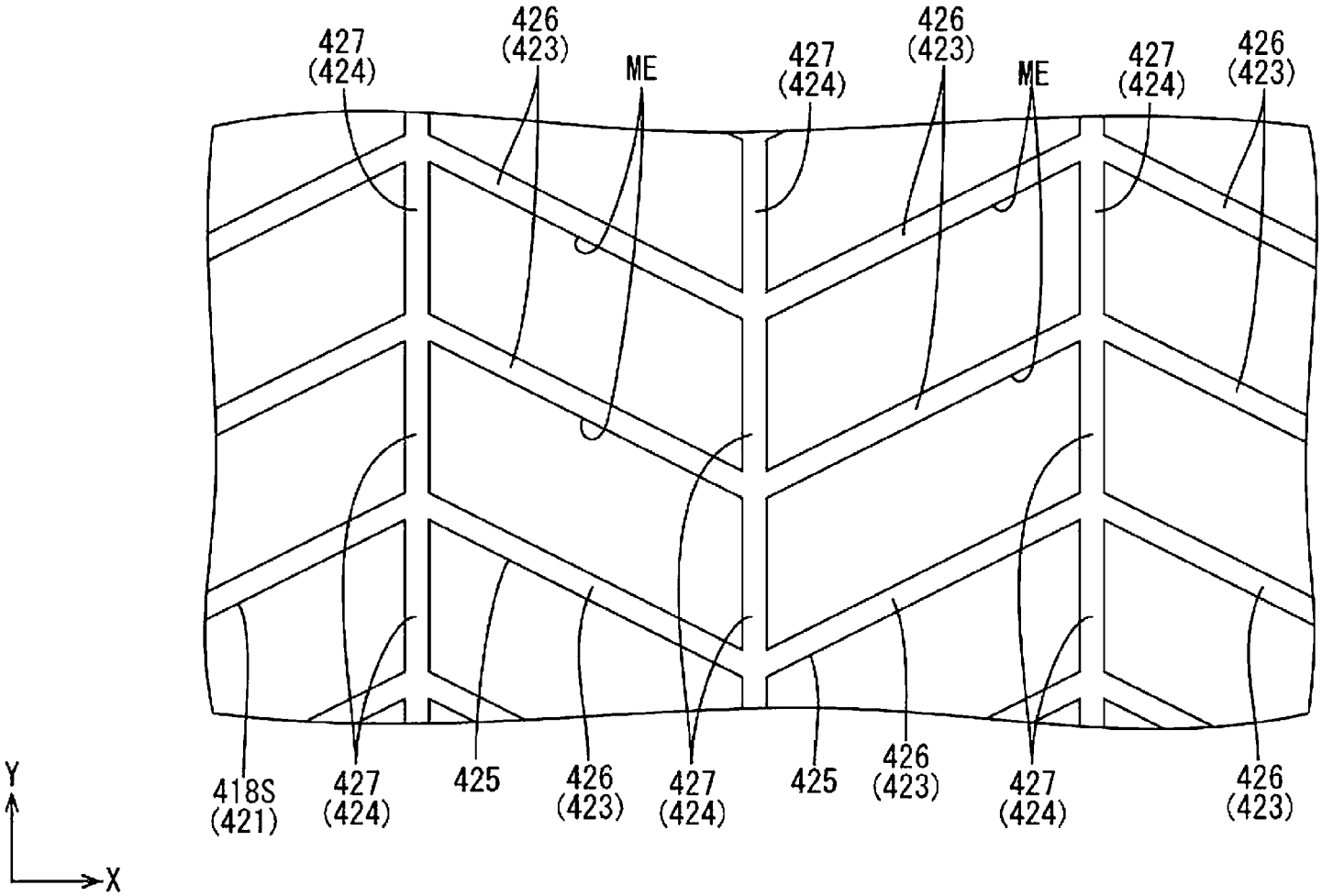
FIG. 20 is a plan view of demarcation parts in a short side part of an antenna wire according to Embodiment 5 of the present invention.
Figure 21:
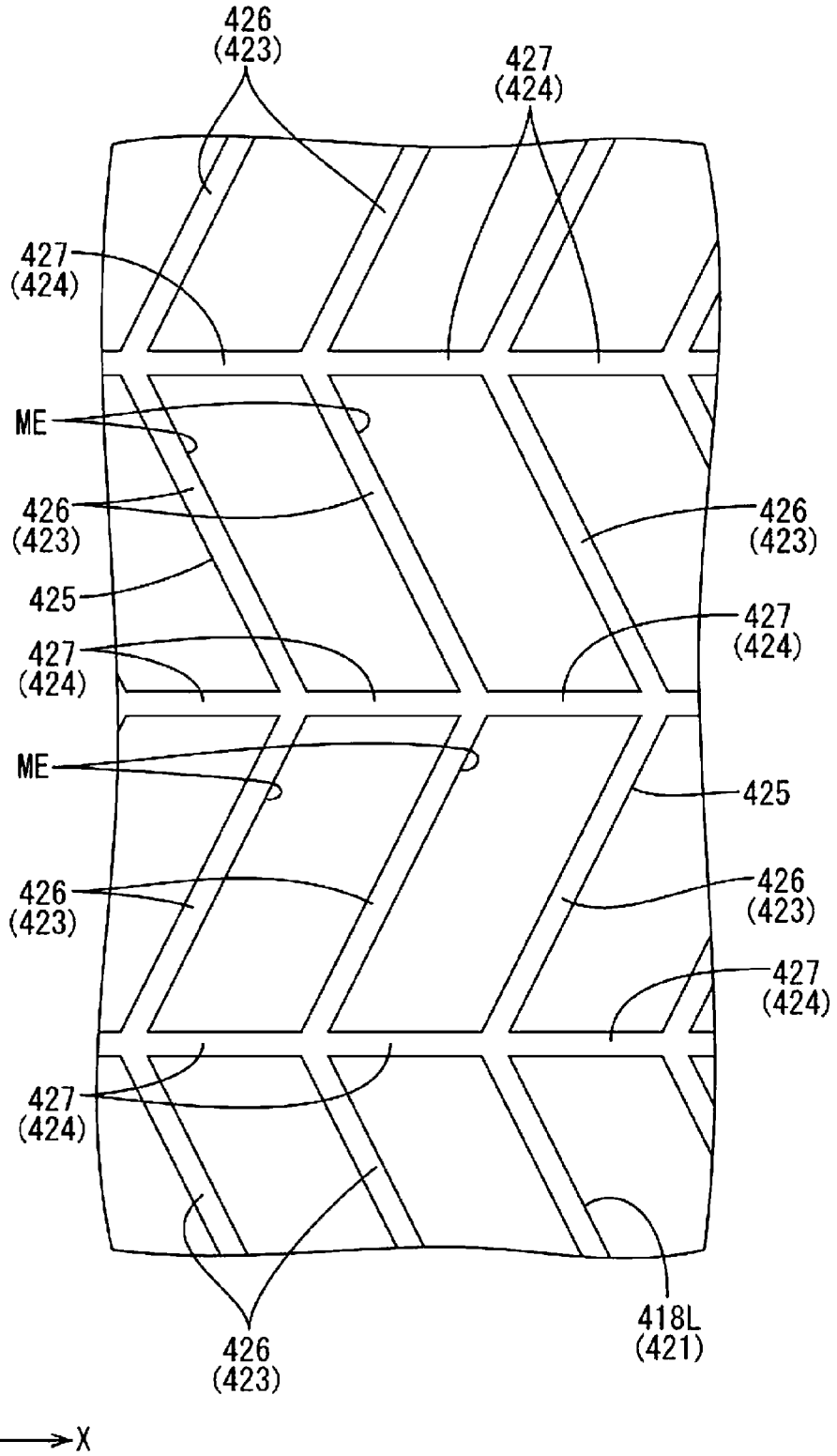
FIG. 21 is a plan view of demarcation parts in a long side part of the antenna wire.

As shown in FIGS. 20 and 21, an antenna wire 421 according to the present embodiment is formed by pattering a reticulated metal film having reticulations ME and demarcation parts 425 whose planar shapes are parallelograms. The demarcation parts 425, which demarcate the reticulations ME, are constituted by first demarcation parts 426 extending along a direction inclined with respect to the direction of extension of the antenna wire 421 and second demarcation parts 427 extending along a direction orthogonal to the direction of extension of the antenna wire 421, with the first demarcation parts 426 serving as the oblique sides of the parallelograms and the second demarcation parts 427 serving as the bases of the parallelograms. Whereas the first demarcation parts 426 have their planar shapes in a staggered zigzag manner, the second demarcation parts 427 have their planar shapes in a linear manner. As shown in FIG. 20, a short side part 418S of the antenna wire 421 is configured such that the first demarcation parts 426 extend along a direction inclined with respect to both the X-axis and Y-axis directions (first and second directions), which are directions parallel to the side parts 418S and 418L, respectively, of the antenna wire 421 and the second demarcation parts 427 extend along the Y-axis direction (second direction), which is a direction orthogonal to the short side part 418S. As shown in FIG. 21, a long side part 418L of the antenna wire 421 is configured such that the first demarcation parts 426 extend along a direction inclined with respect to both the X-axis and Y-axis directions (first and second directions) and the second demarcation parts 427 extend along the X-axis direction (first direction), which is a direction orthogonal to the long side part 418L.

Moreover, as shown in FIGS. 20 and 21, the antenna wire 421 is configured such that the length of each of the first demarcation parts 426 (i.e. the spacing between adjacent second demarcation parts 427 with a reticulation ME interposed therebetween) is longer (wider) than the length of each of the second demarcation parts 427 (i.e. the spacing between adjacent first demarcation parts 426 with a reticulation ME interposed therebetween). Therefore, whereas a reticulation ME defined by demarcation parts 426 and 427 in a short side part 418S has a horizontally long parallelogramatic shape (FIG. 20), a reticulation ME defined by demarcation parts 426 and 427 in a long side part 418L has a vertically long parallelogramatic shape (FIG. 21). In other words, since the length of each of the second demarcation parts 427 is narrower than the length of each of the first demarcation parts 426, the number of first demarcation parts 426 that are had by a first extension part 423 is larger than the number of second demarcation parts 427 that are had by a second extension part 424. This allows the per unit length area of the first extension part 423 comprising the plurality of first demarcation parts 426 to be larger than the per unit length area of the second extension part 424 comprising the plurality of second demarcation parts 427.

According to the present embodiment, as described above, the antenna wire 421 has a planar shape forming a quadrangular ring and has a pair of short side parts 418S extending parallel to a first direction and a pair of long side parts 418L extending parallel to a second direction orthogonal to the first direction, the short side parts 418S are each configured such that the first demarcation part 426 extends along a direction inclined with respect to the first and second directions and the second demarcation part 427 extends along the second direction, and the long side parts 418L are each configured such that the first demarcation part 426 extends along a direction inclined with respect to the first and second directions and the second demarcation part 427 extends along the first direction. In this way, in each of the short side parts 418S, of the antenna wire 421 having a planar shape forming a quadrangular ring, which extend parallel to the first direction, the per unit length area of the first extension part 423 comprising a plurality of the first demarcation parts 426 extending along a direction inclined with respect to the first and second directions is larger than the per unit length area of the second extension part 424 comprising a plurality of the second demarcation parts 427 extending along the second direction orthogonal to the first direction. On the other hand, in each of the long side parts 418L, of the antenna wire 421, which extend parallel to the second direction, the per unit length area of the first extension part 423 comprising a plurality of the first demarcation parts 426 extending along a direction inclined with respect to the first and second directions is larger than the per unit length area of the second extension part 424 comprising a plurality of the second demarcation parts 427 extending along the first direction. This makes it possible to achieve a reduction in wiring resistance while achieving sufficient light transmittance.

Embodiment 6

Embodiment 6 of the present invention is described with reference to FIG. 22 or 23. Embodiment 6 illustrates different planar shapes of reticulations ME and demarcation parts 525 from Embodiment 5 described above. It should be noted that a repeated description of structures, actions, and effects which are similar to those of Embodiment 5 described above is omitted.

Figure 22:
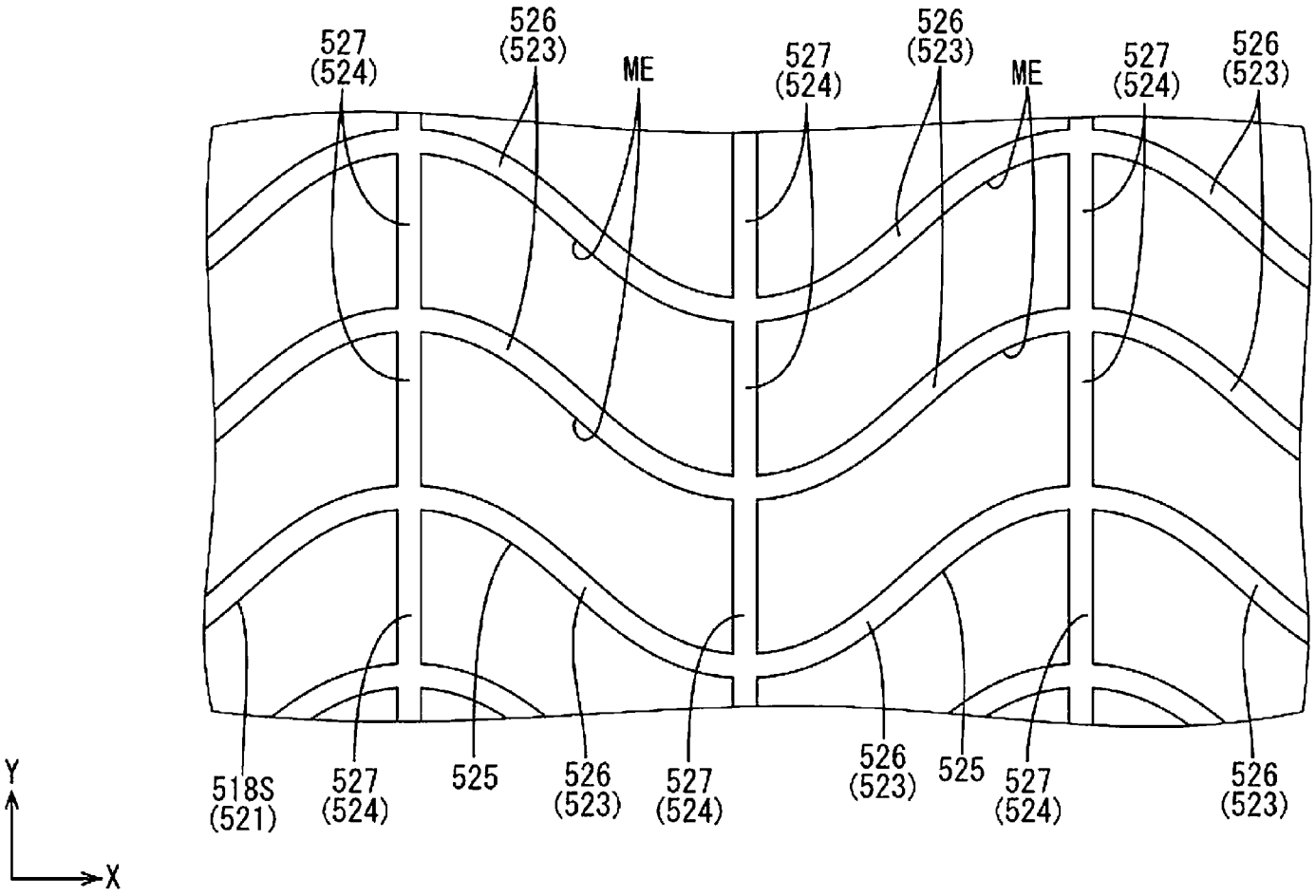
FIG. 22 is a plan view of demarcation parts in a short side part of an antenna wire according to Embodiment 6 of the present invention.
Figure 23:
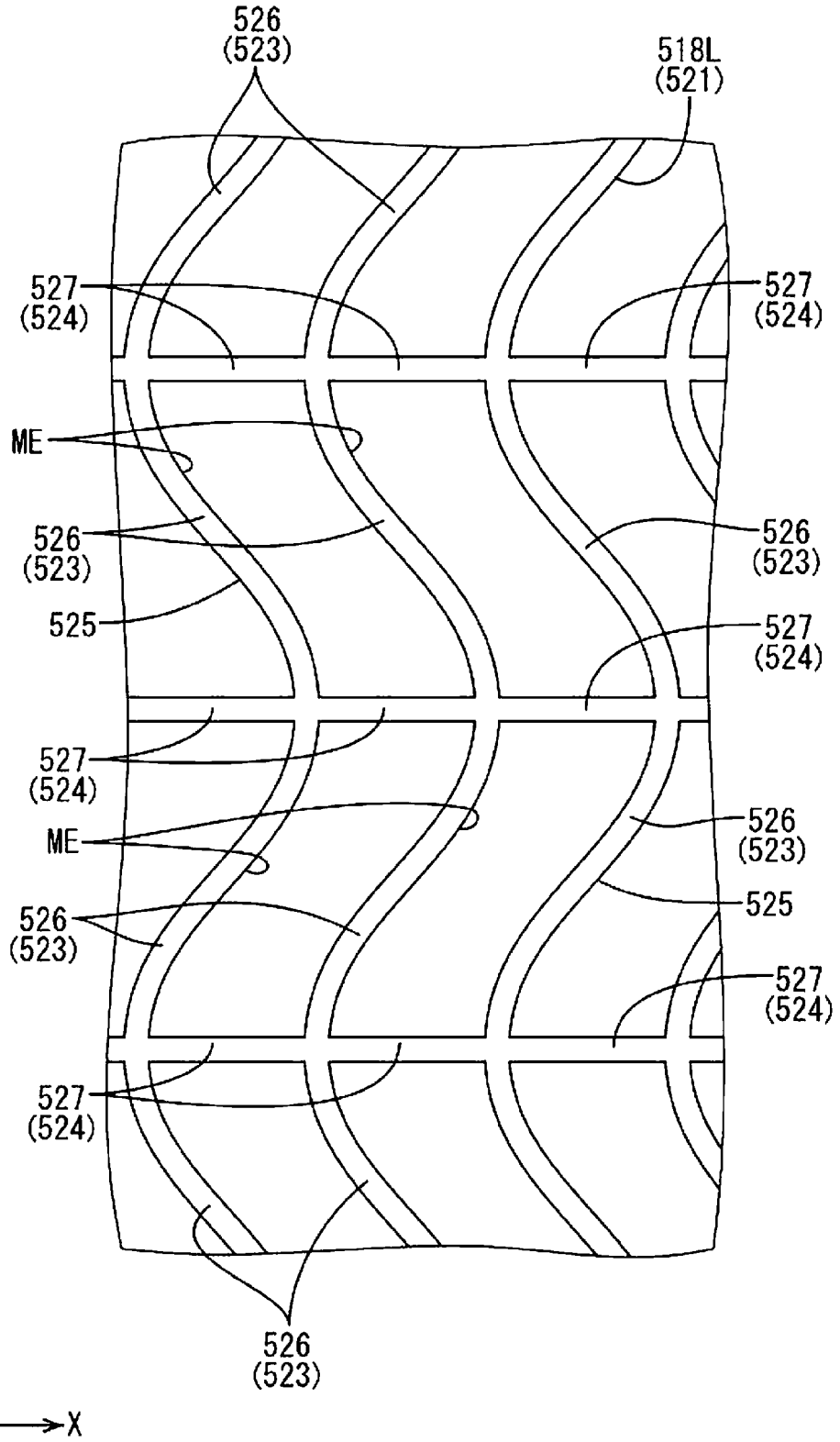
FIG. 23 is a plan view of demarcation parts in a long side part of the antenna wire.

As shown in FIGS. 22 and 23, an antenna wire 521 according to the present embodiment is configured such that the planar shapes of first demarcation parts 526 of demarcation parts 525 demarcating reticulations ME are curved. Specifically, each of the first demarcation parts 526 extends in such a form as to intersect with both the X-axis and Y-axis directions (first and second directions), which are directions parallel to side parts 518S and 518L, respectively, of the antenna wire 521, and has a planar shape forming a sinusoidal waveform (i.e. a waveform that undergoes a periodic change). Moreover, the antenna wire 521 is configured such that the length of each of the first demarcation part 526 (i.e. the spacing between adjacent second demarcation parts 527 with a reticulation ME interposed therebetween) is longer (wider) than the length of each of the second demarcation parts 527 (i.e. the spacing between adjacent first demarcation parts 526 with a reticulation ME interposed therebetween), whereby the number of first demarcation parts 526 that are had by a first extension part 523 is larger than the number of second demarcation parts 527 that are had by a second extension part 524.

According to the present embodiment, as described above, the antenna wire 521 has a planar shape forming a quadrangular ring and has a pair of short side parts 518S extending parallel to a first direction and a pair of long side parts 518L extending parallel to a second direction orthogonal to the first direction, the short side parts 518S are each configured such that the first demarcation part 526 extends in such a form as to intersect with the first direction and the second direction and has a planar shape forming a curve and the second demarcation part 527 extends along the second direction, and the long side parts 518L are each configured such that the first demarcation part 526 extends in such a form as to intersect with the first direction and the second direction and has a planar shape forming a curve and the second demarcation part 527 extends along the first direction. In this way, in each of the short side parts 518S, of the antenna wire 521 having a planar shape forming a quadrangular ring, which extend parallel to the first direction, the per unit length area of the first extension part 523 comprising a plurality of the first demarcation parts 526 each extending in such a form as to intersect with the first direction and the second direction and having a planar shape forming a curve is larger than the per unit length area of the second extension part 524 comprising a plurality of the second demarcation parts 527 extending along the second direction orthogonal to the first direction. On the other hand, in each of the long side parts 518L, of the antenna wire 521, which extend parallel to the second direction, the per unit length area of the first extension part 523 comprising a plurality of the first demarcation parts 526 each extending in such a form as to intersect with the first direction and the second direction and having a planar shape forming a curve is larger than the per unit length area of the second extension part 524 comprising a plurality of the second demarcation parts 527 extending along the first direction. This makes it possible to achieve a reduction in wiring resistance while achieving sufficient light transmittance.

Embodiment 7

Embodiment 7 of the present invention is described with reference to FIG. 24 or 25. Embodiment 7 illustrates a different patterning of a reticulated metal film constituting a transparent antenna 617 from Embodiment 1 described above. It should be noted that a repeated description of structures, actions, and effects which are similar to those of Embodiment 1 described above is omitted.

Figure 24:
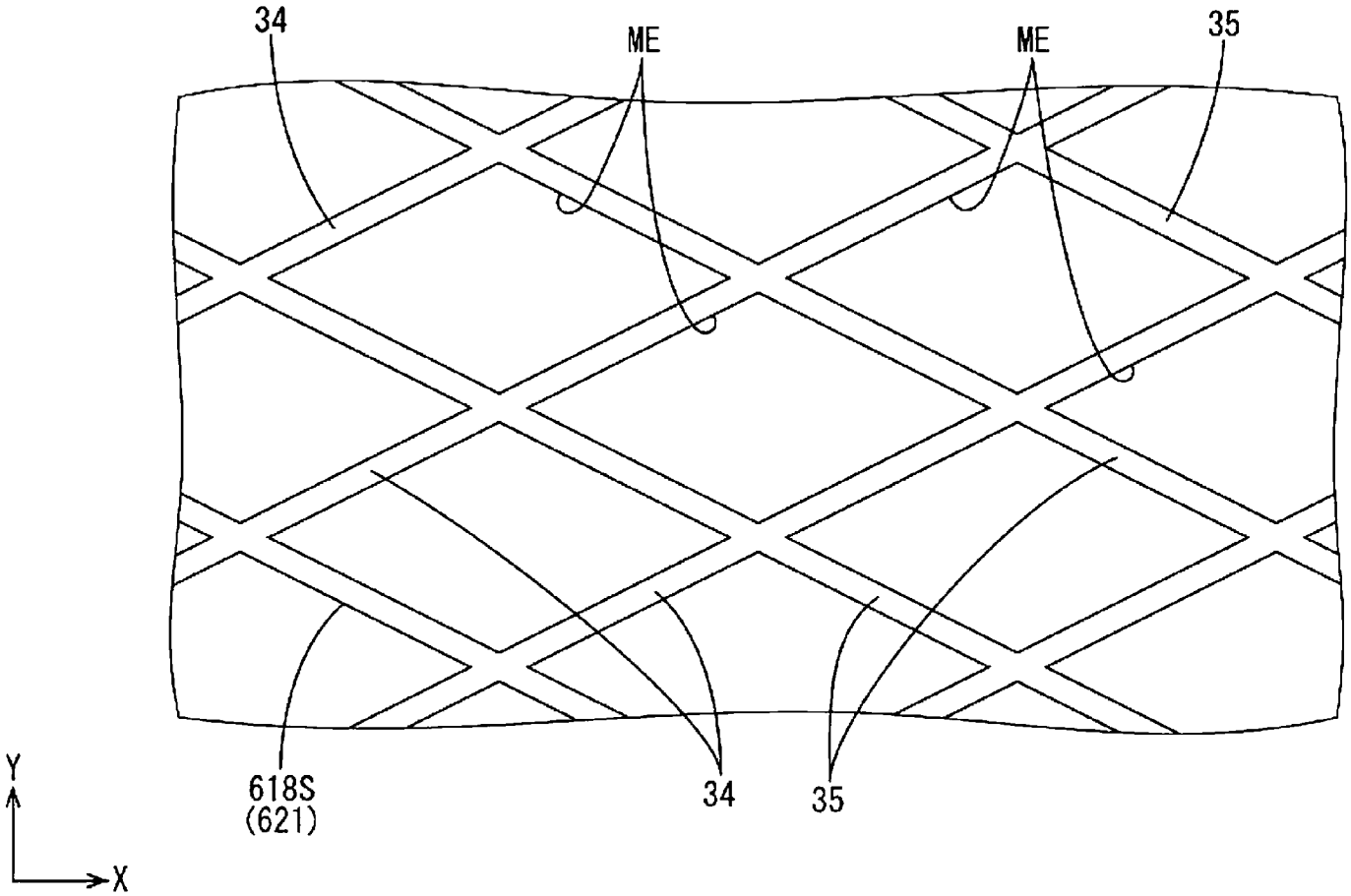
FIG. 24 is a plan view of demarcation parts in a short side part of an antenna wire according to Embodiment 7 of the present invention.
Figure 25:
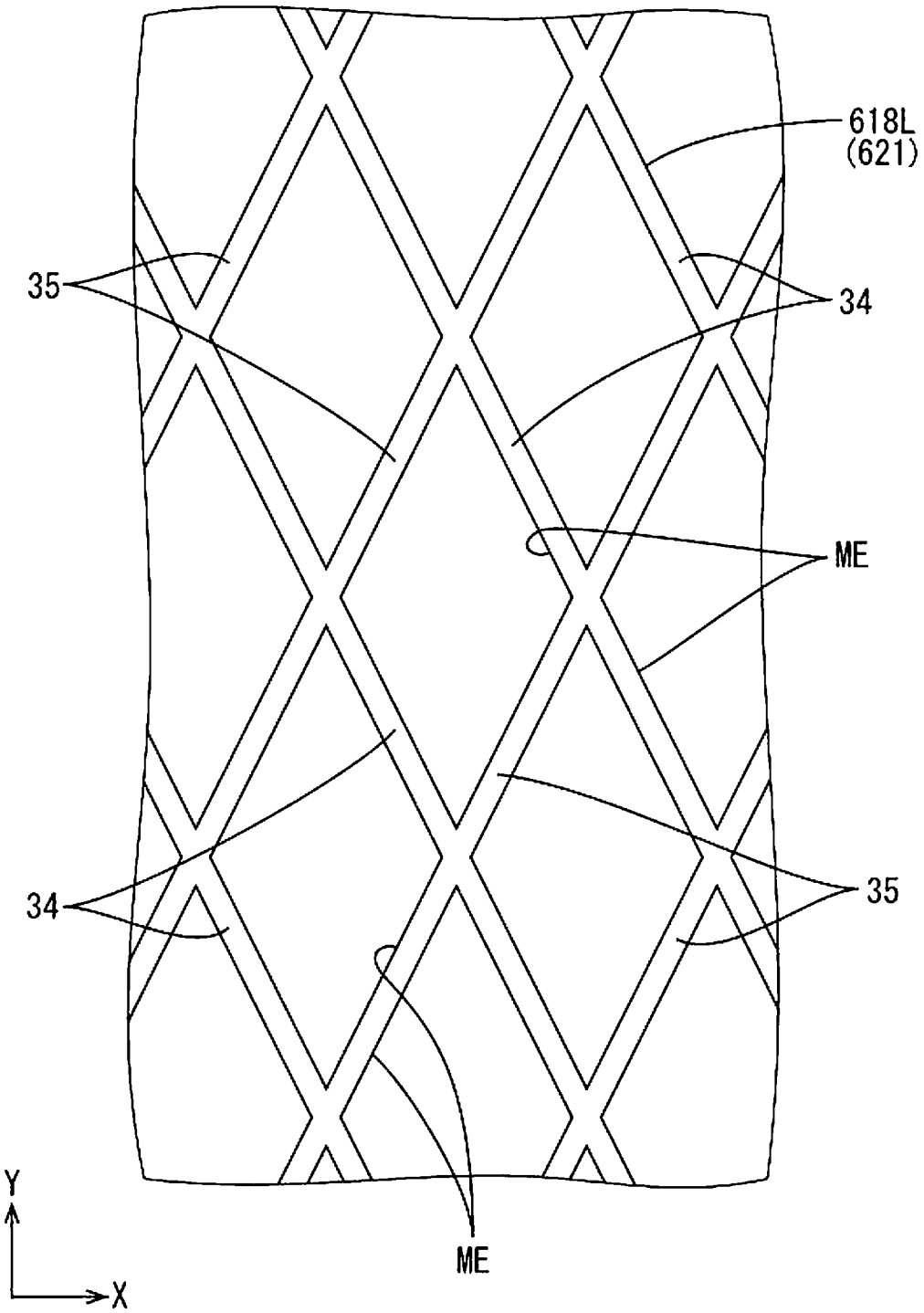
FIG. 25 is a plan view of demarcation parts in a long side part of the antenna wire.

As shown in FIGS. 24 and 25, the transparent antenna 617 according to the present embodiment is configured such that an antenna wire 621 has a first extension part 34 extending along a direction inclined with respect to both the direction of extension of the antenna wire 621 and a direction orthogonal thereto and a second extension part 35 connected to the first extension part 34 by extending along a direction inclined with respect to both the direction of extension and the direction orthogonal thereto and intersecting with the first extension part 34 and that each of the first and second extension parts 34 and 35 is inclined at a smaller angle with respect to the direction of extension than with respect to the direction orthogonal to the direction of extension. The angle of inclination of the first extension part 34 with respect to the direction of extension of the antenna wire 621 (direction orthogonal to the direction of extension) is equal to the angle of inclination of the second extension part 35 with respect to the direction of extension of the antenna wire 621 (direction orthogonal to the direction of extension). The first and second extension parts 34 and 35 connected to each other are configured to form linear shapes with each other and demarcate reticulations ME whose planar shapes are flat rhombuses.

As shown in FIG. 24, a short side part 618S of the antenna wire 621 is configured such that the angle of inclination of the first extension part 34 and second extension part 35 with respect to the X-axis direction (first direction), which is a direction (direction of extension) parallel to the short side part 618S, is relatively smaller than the angle of inclination of the first extension part 34 and the second extension part 35 with respect to the Y-axis direction (second direction), which is a direction orthogonal to the X-direction. Therefore, the planar shapes of the reticulations ME that the short side part 618S has are horizontally long rhombuses. As shown in FIG. 25, a long side part 618L of the antenna wire 621 is configured such that the angle of inclination of the first extension part 34 and the second extension part 35 with respect to the Y-axis direction (first direction), which is a direction (direction of extension) parallel to the long side part 618L, is relatively smaller than the angle of inclination of the first extension part 34 and the second extension part 35 with respect to the X-axis direction (second direction), which is a direction orthogonal to the Y-axis direction. Therefore, the planar shapes of the reticulations ME that the long side part 618L has are vertically long rhombuses.

Incidentally, in the first extension part 34 extending along a direction inclined with respect to both the direction of extension of the antenna wire 621 and a direction orthogonal thereto and the second extension part 35 extending in such a form as to be inclined with respect to both the direction of extension of the antenna wire 621 and the direction orthogonal thereto and intersect with the direction of extension of the first extension part 34, the path length in the direction of extension of the antenna wire 621 tends to become longer and the path length in the direction orthogonal to the direction of extension of the antenna wire 621 tends to become shorter as the angle of inclination with respect to the direction of extension of the antenna wire 621 becomes larger and the angle of inclination with respect to the direction orthogonal to the direction of extension of the antenna wire 621 becomes smaller, and the path length in the direction of extension of the antenna wire 621 tends to become shorter and the path length in the direction orthogonal to the direction of extension of the antenna wire 621 tends to become longer as the angle of inclination with respect to the direction of extension of the antenna wire 621 becomes smaller and the angle of inclination with respect to the direction orthogonal to the direction of extension of the antenna wire 621 becomes larger. Moreover, since, as described above, the antenna wire 621 is configured such that each of the first and second extension parts 34 and 35 is inclined at a smaller angle with respect to the direction of extension of the antenna wire 621 than with respect to the direction orthogonal to the direction of extension of the antenna wire 621, the path length in the direction of extension of the antenna wire 621 becomes shorter. This makes it possible to efficiently lower the wiring resistance while sufficiently securing the opening area of the reticulations ME. This in turn makes it possible to achieve a reduction in wiring resistance while achieving sufficient light transmittance.

As described above, the present embodiment includes an antenna wire 621, formed by a reticulated metal film in a shape of a ring, which generates a magnetic field on a center side thereof. The antenna wire 621 has a first extension part 34 extending along a direction inclined with respect to both a direction of extension of the antenna wire and a direction orthogonal thereto and a second extension part 35 extending along a direction inclined with respect to both the direction of extension and the direction orthogonal thereto and intersecting with the first extension part 34. The antenna wire 621 is configured such that each of the first and second extension parts 34 and 35 is inclined at a smaller angle with respect to the direction of extension than with respect to the direction orthogonal to the direction of extension.

In this way, the flow of an electric current through the ring-shaped antenna wire 621 causes a magnetic field to be generated on the center side of the antenna wire 621 by an electromagnetic induction effect. The antenna wire 621 is formed by the reticulated metal film, which has reticulations ME through which light is transmitted, whereby the translucency of the transparent antenna is secured. The wiring resistance of the antenna wire 621 tends to become lower as the opening area of the reticulations ME in the metal film becomes smaller and the area of the metal film becomes larger, and tends to become higher as the opening area of the reticulations ME in the metal film becomes larger and the area of the metal film becomes smaller. Note here that, in the first extension part 34 extending along a direction inclined with respect to both the direction of extension of the antenna wire 621 and a direction orthogonal thereto and the second extension part 35 extending along a direction inclined with respect to both the direction of extension of the antenna wire 621 and the direction orthogonal thereto and intersecting with the direction of extension of the first extension part 34, the path length in the direction of extension of the antenna wire 621 tends to become longer and the path length in the direction orthogonal to the direction of extension of the antenna wire 621 tends to become shorter as the angle of inclination with respect to the direction of extension of the antenna wire 621 becomes larger and the angle of inclination with respect to the direction orthogonal to the direction of extension of the antenna wire 621 becomes smaller, and the path length in the direction of extension of the antenna wire 621 tends to become shorter and the path length in the direction orthogonal to the direction of extension of the antenna wire 621 tends to become longer as the angle of inclination with respect to the direction of extension of the antenna wire 621 becomes smaller and the angle of inclination with respect to the direction orthogonal to the direction of extension of the antenna wire 621 becomes larger.

Moreover, since the antenna wire 621 is configured such that each of the first and second extension parts 34 and 35 is inclined at a smaller angle with respect to the direction of extension of the antenna wire 621 than with respect to the direction orthogonal to the direction of extension of the antenna wire 621, the path length in the direction of extension of the antenna wire 621 becomes shorter. This makes it possible to efficiently lower the wiring resistance while sufficiently securing the opening area of the reticulations ME. This in turn makes it possible to achieve a reduction in wiring resistance while achieving sufficient light transmittance.

Embodiment 8

Embodiment 8 of the present invention is described with reference to FIG. 26 or 27. Embodiment 8 illustrates different planar shapes of first and second extension parts 734 and 735 from Embodiment 7 described above. It should be noted that a repeated description of structures, actions, and effects which are similar to those of Embodiment 7 described above is omitted.

Figure 26:
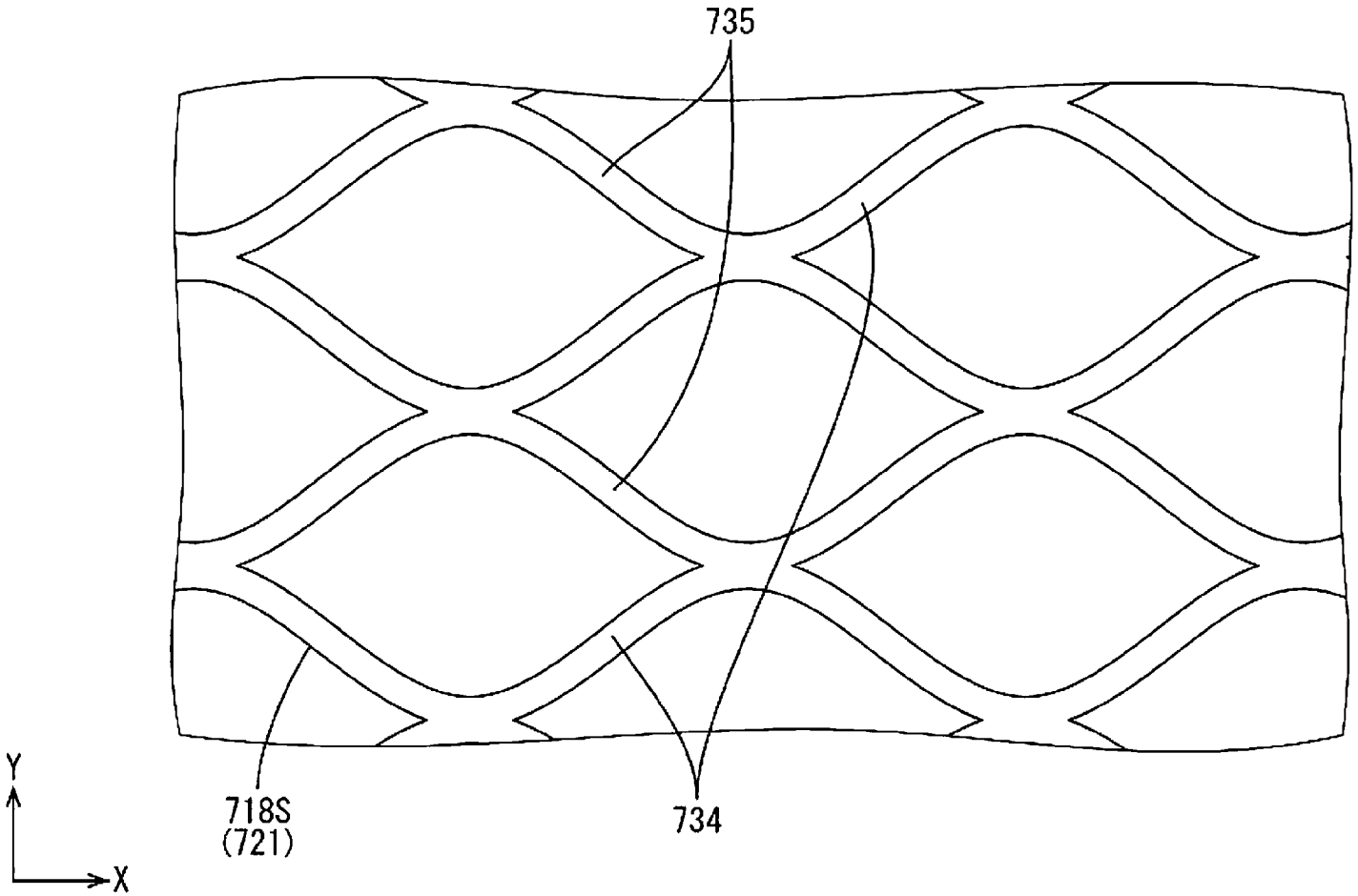
FIG. 26 is a plan view of demarcation parts in a short side part of an antenna wire according to Embodiment 8 of the present invention.
Figure 27:
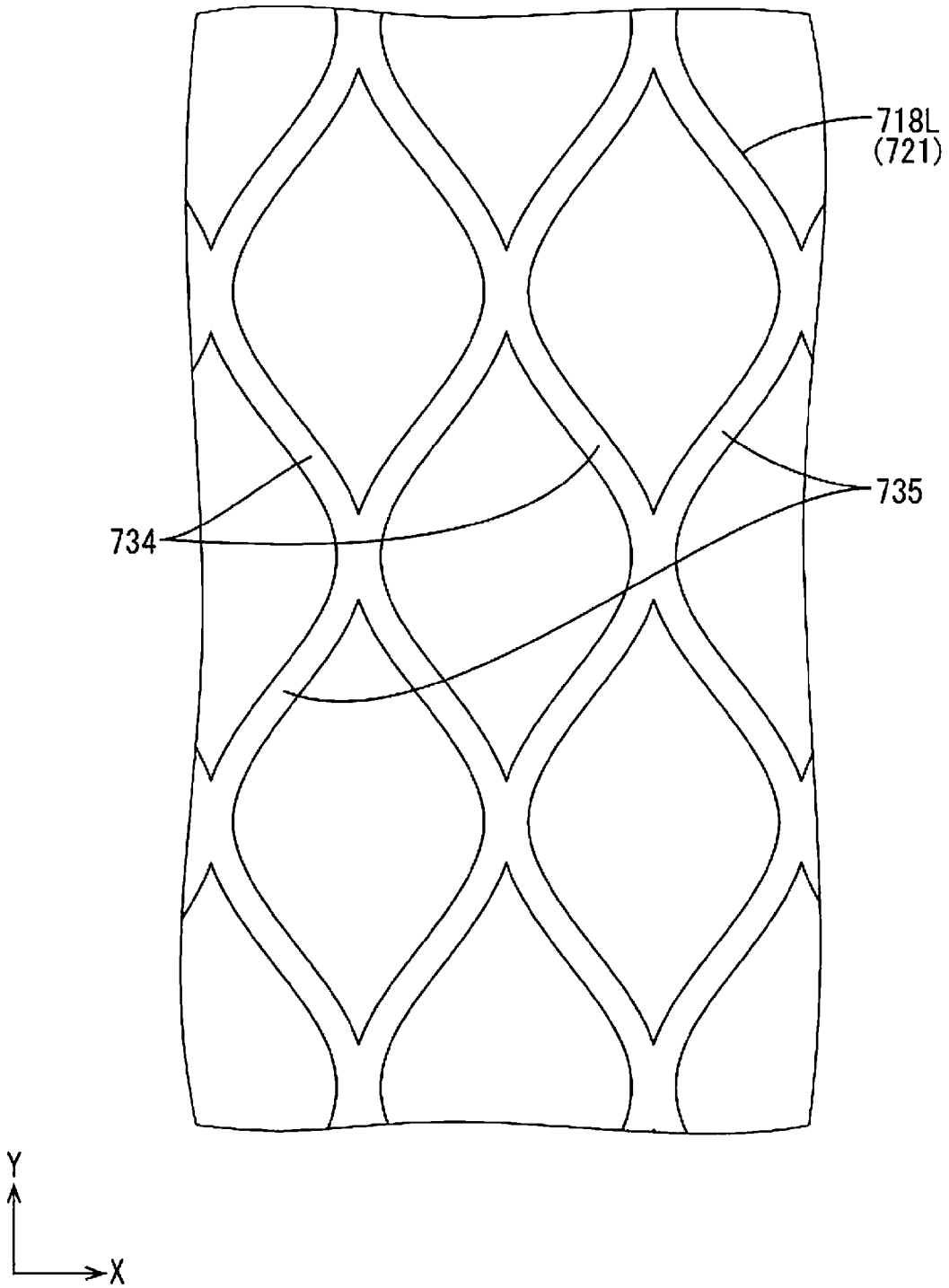
FIG. 27 is a plan view of demarcation parts in a long side part of the antenna wire.

As shown in FIGS. 26 and 27, an antenna wire 721 according to the present embodiment is configured such that the planar shapes of first and second extension parts 734 and 735 constituting long and short side parts 718L and 718S are both curved.

Embodiment 9

Embodiment 9 of the present invention is described with reference to FIG. 28. Embodiment 9 illustrates a different placement of a transparent antenna 817 from Embodiment 1 described above. It should be noted that a repeated description of structures, actions, and effects which are similar to those of Embodiment 1 described above is omitted.

Figure 28:
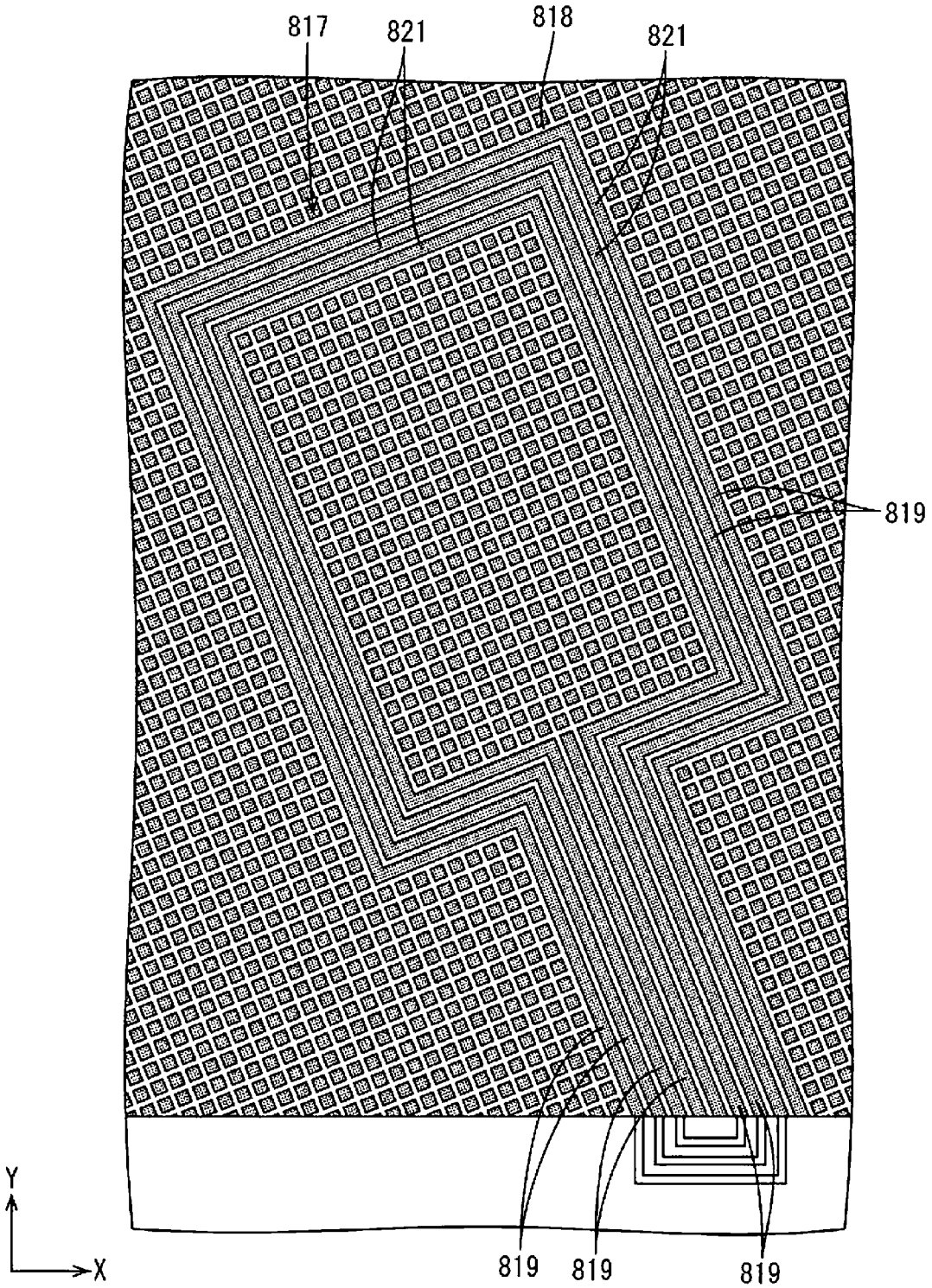
FIG. 28 is a plan view of a transparent antenna according to Embodiment 9 of the present invention.

As shown in FIG. 28, the transparent antenna 817 according to the present embodiment is placed such that the long and short side directions of an antenna body part 818 and the direction of extension of lead wiring parts 819 are each inclined with respect to both the X-axis and Y-axis directions, which are the long and short side directions of a liquid crystal panel (not illustrated). The transparent antenna 817 is constituted by a reticulated metal film configured such that, of demarcation parts demarcating reticulations, first demarcation parts extend along the direction of extension of antenna wires 821 and second demarcation parts extend along a direction orthogonal to the antenna wires 821. The direction of extension of the antenna wires 821 and the direction orthogonal thereto are each inclined with respect to both the X-axis and Y-axis directions. A large number of the reticulations had by the transparent antenna 817 are arranged in a matrix along the direction of extension of the antenna wires 821 and the direction orthogonal thereto, and the directions of arrangement are inclined with respect to both the X-axis and Y-axis directions. Meanwhile, the liquid crystal panel has a large number of pixels arranged in a matrix along the long and short side directions thereof, and the directions of arrangement are parallel to the X-axis direction and the Y-axis direction. Therefore, in this placement, the direction of arrangement of the reticulations had by the transparent antenna 817 and the direction of arrangement of the pixels had by the liquid crystal panel are inclined with respect to each other. This makes it difficult for interference to occur between the pixels of the liquid crystal panel and the reticulations of the transparent antenna 817 and therefore makes it difficult for interference fringes called moiré to appear on an image displayed on the liquid crystal panel, thereby achieving high display quality.

According to the present embodiment, as described above, the liquid crystal panel has a large number of pixels arranged in a matrix in a plane of a display surface of the liquid crystal panel, the transparent antenna 817 has a large number of reticulations arranged in a matrix, and a direction of arrangement of the reticulations is inclined with respect to a direction of arrangement of the pixels. In this way, the inclination of the direction of arrangement of the reticulations of the transparent antenna 817 with respect to the direction of arrangement of the pixels in the liquid crystal panel reduces the appearance of interference fringes called moiré, thereby bringing about improvement in display quality.

Other Embodiments

The present invention is not limited to the embodiments described above with reference to the foregoing descriptions and drawings. For example, the following embodiments are encompassed in the technical scope of the present invention:

(1) Besides the embodiments described above (excluding Embodiments 7 and 8), changes can be made as appropriate to specific numerical values, ratios, and the like such as the line widths of the first and second demarcation parts, the spacing between adjacent first demarcation parts with a reticulation interposed therebetween (i.e. the length of each of the second demarcation parts), and the spacing between adjacent second demarcation parts with a reticulation interposed therebetween (i.e. the length of each of the first demarcation parts).

(2) Besides Embodiments 7 and 8 described above, changes can be made as appropriate to specific numerical values, ratios, and the like such as the line widths of the first and second extension parts, the spacing between adjacent first extension parts, and the spacing between adjacent second extension parts.

(3) While Embodiment 2 described above illustrates a case where the spacing between adjacent second demarcation parts with a reticulation interposed therebetween (i.e. the length of each of the first demarcation parts) is wider (longer) than the spacing between adjacent first demarcation parts with a reticulation interposed therebetween (i.e. the length of each of the second demarcation parts), the former can be narrower (shorter) than the latter. In that case, a rise in wiring resistance can be suppressed simply by widening the difference between the line width of each of the first demarcation parts and the line width of each of the second demarcation parts.

(4) While Embodiment 2 described above illustrates a case where the line width of each of the first demarcation parts is wider than the line width of each of the second demarcation parts, the former can be narrower than the latter. In that case, a rise in wiring resistance can be suppressed simply by widening the difference between the spacing between adjacent second demarcation parts with a reticulation interposed therebetween (i.e. the length of each of the first demarcation parts) and the spacing between adjacent first demarcation parts with a reticulation interposed therebetween (i.e. the length of each of the second demarcation parts).

(5) While each of Embodiments 3 to 6 described above illustrates a case where the number of second demarcation parts is made smaller than the number of first demarcation parts by making the spacing between adjacent second demarcation parts with a reticulation interposed therebetween (i.e. the length of each of the first demarcation parts) wider (longer) than the spacing between adjacent first demarcation parts with a reticulation interposed therebetween (i.e. the length of each of the second demarcation parts), the number of second demarcation parts can be made even smaller by arranging the second demarcation parts in a staggered manner in addition to making the spacing between adjacent second demarcation parts with a reticulation interposed therebetween (i.e. the length of each of the first demarcation parts) wider (longer) than the spacing between adjacent first demarcation parts with a reticulation interposed therebetween (i.e. the length of each of the second demarcation parts). Alternatively, the number of second demarcation parts can be made smaller than the number of first demarcation parts by making the spacing between adjacent first demarcation parts with a reticulation interposed therebetween and the spacing between adjacent first demarcation parts with a reticulation interposed therebetween equal and then arranging the second demarcation parts in a staggered manner.

(6) While each of the embodiments described above illustrates a case where slits forming a grid are formed in the antenna-free region of the reticulated metal film constituting the transparent antenna, it is alternatively possible to employ a configuration in which no such slits are formed in the antenna-free region.

(7) While each of the embodiments described above illustrates a case where the transparent antenna is placed near the position of a lower edge of the liquid crystal panel in the Y-axis direction, it is possible to appropriately change the specific placement of the transparent antenna in the X-axis direction and the Y-axis direction in the plane of the liquid crystal panel. For example, the transparent antenna may be placed near a middle or upper position in the Y-axis direction in the plane of the liquid crystal panel, or may be placed in a middle position or the like in the X-axis direction.

(8) While each of the embodiments described above illustrates a case where the planar shape of the antenna body part is a vertically long quadrangular shape, the planar shape of the antenna body part may alternatively be a vertically long quadrangular shape or a square. Apart from these shapes, the planar shape of the antenna body part may be a circle, an ellipse, or the like.

(9) While each of the embodiments described above illustrates a case where the lead wiring part is configured to extend from the antenna body part downward in the Y-axis direction in the liquid crystal display device, it is alternatively possible to configure the lead wiring part to extend from the antenna body part upward in the Y-axis direction in the liquid crystal display device. Furthermore, it is alternatively possible to configure the lead wiring part to extend from the antenna body part either leftward or rightward in the X-axis direction in the liquid crystal display device. In that case, it is preferable that the placement of the antenna body part be rotated 90 degrees.

(10) While each of the embodiments described above illustrates an antenna body part constituted by four antenna wires, it is possible to appropriately change the number of antenna wires (number of turns) that constitute the antenna body part. In the case of a change in the number of antenna wires, it is only necessary to appropriately change the number of lead wiring parts and the number of antenna connection wiring parts accordingly.

(11) While each of the embodiments described above illustrates a case where the transparent antenna has a symmetrical shape, the transparent antenna may alternatively have an asymmetrical shape.

(12) While each of the embodiments described above illustrates an antenna body part formed in the shape of a closed ring surrounding the magnetic field generation region, the present invention is also applicable to an antenna body part formed in the shape of an open ring so that each of the antenna wires has its two ends opened.

(13) While each of the embodiments described above illustrates a case where the planar shape of the liquid crystal panel is a horizontally long quadrangular shape, the planar shape of the liquid crystal panel may alternatively be a vertically long quadrangular shape or a square. Apart from these shapes, the planar shape of the liquid crystal panel may be a circle, an ellipse, or the like; furthermore, the planar shape of the outer edges of the liquid crystal panel may be formed in the shape of a combination of straight and curved lines.

(14) The technical matters described in the embodiments described above may be appropriately combined.

(15) While each of the embodiments described above illustrates a liquid crystal display device including a liquid crystal panel having a screen size of 30-something inches to 50-something inches, the present invention is also applicable to a liquid crystal display device including a liquid crystal panel having a screen size of 30 inches or smaller or a screen size of 60 inches or larger.

(16) While each of the embodiments described above illustrates a liquid crystal display device that is used in an electronic device such as an information display, an electronic blackboard, and a television receiving apparatus, the present invention is also applicable to a liquid crystal display device that is used in any of other types of electronic device such as PC monitors (including desktop PC monitors and laptop PC monitors), tablet terminals, phablet terminals, smartphones, mobile phones, and mobile game machines.

(17) While each of the embodiments described above illustrates a liquid crystal panel (VA-mode liquid crystal panel) configured such that the array substrate is provided with pixel electrodes, that the CF substrate is provided with a common electrode, and that the pixel electrodes and the common electrode overlap each other with a liquid crystal layer sandwiched therebetween, the present invention is also applicable to a liquid crystal display device including a liquid crystal panel (FFS-mode liquid crystal panel) configured such that the array substrate is provided with both pixel electrodes and a common electrode and the pixel electrodes and the common electrode overlap each other with an insulating film sandwiched therebetween. The present invention is also applicable to a liquid crystal display device including a so-called IPS-mode liquid crystal panel.

(18) While each of the embodiments described above illustrates a case where the color filter of the liquid crystal panel is constituted by three colors of red, green, and blue, the present invention is also applicable to a liquid crystal panel including a color filter constituted by four colors by adding a colored portion of yellow to the colored portions of red, green, and blue.

(19) While each of the embodiments described above illustrates a transmissive liquid crystal display device including a backlight device serving as an external light source, the present invention is also applicable to a reflective liquid crystal display device that performs a display by means of outside light. In that case, the backlight device may be omitted. Further, the present invention is also applicable to a semi-transmissive liquid crystal display device.

(20) While each of the embodiments described above uses TFTs as the switching elements of the liquid crystal panel, it is also applicable to a liquid crystal display device including a liquid crystal panel including switching elements other than TFTs (e.g. thin-film diodes (TFDs)). It is also applicable to a liquid crystal display device including a liquid crystal panel that performs a black-and-white display as well as a liquid crystal display device including a liquid crystal panel that performs a color display.

(21) While each of the embodiments described above illustrates a liquid crystal display device including a liquid crystal panel as a display panel, the present invention is also applicable to a display device including any of other types of display panel (such as PDPs (plasma display panels), organic EL panels, and EPDs (electrophoretic display panels)). In these cases, the backlight device may be omitted. Further, the present invention is also applicable to a display device including a MEMS display panel.

(22) While each of the embodiments described above illustrates a case where the per unit length areas of the corner-part first and second extension parts constituting a corner part of the transparent antenna are equal to each other, the corner-part first and second extension parts may alternatively be configured to be different in size of per unit length area. Further, the per unit length area of the corner-part first extension part in the corner part may be equal to or larger than the per unit length area of the first extension part in each side part. Similarly, the per unit length area of the corner-part second extension part in the corner part may be equal to or smaller than the per unit length area of the second extension part in each side part.

REFERENCE SIGNS LIST

10 . . . liquid crystal display device (transparent antenna-equipped display device), 11 . . . liquid crystal panel (display panel), 12 . . . transparent antenna substrate, 17, 817 . . . transparent antenna, 18C . . . corner part, 18L, 118L, 218L, 318L, 418L, 518L, 618L, 718L . . . long side part (second side part), 18S, 118S, 218S, 318S, 418S, 518S, 618S, 718S . . . short side part (first side part), 19, 819 . . . lead wiring part, 21, 121, 221, 321, 421, 521, 621, 721, 821 . . . antenna wire, 23, 223, 323, 423, 523 . . . first extension part, 24, 224, 324, 424, 524 . . . second extension part, 25, 425, 525 . . . demarcation part, 26, 126, 226, 326, 426, 526 . . . first demarcation part, 27, 127, 227, 327, 427, 527 . . . second demarcation part, 28 . . . corner-part first extension part, 29 . . . corner-part second extension part, 32 . . . first lead extension part, 33 . . . second lead extension part, 34, 734 . . . first extension part, 35, 735 . . . second extension part, AA . . . display region, L1 to L7 . . . spacing, ME . . . reticulation, NAA . . . non-display region, W1 to W5 . . . line width

What is claimed is:

1. A transparent antenna comprising: an antenna wire, formed by a reticulated metal film in a shape of a ring, which generates a magnetic field on a center side thereof, wherein the antenna wire has a first extension part extending along an extending direction that the antenna wire extends and a second extension part extending along a direction intersecting with the extending direction, and the antenna wire is configured such that a per unit length area of the first extension part is larger than a per unit length area of the second extension part, wherein the antenna wire has a plurality of reticulations and a plurality of demarcation parts demarcating the reticulations, the demarcation parts being each constituted by a first demarcation part extending along the extending direction and a second demarcation part extending along a direction intersecting with the extending direction, the first extension part comprises a plurality of the first demarcation parts, and the second extension part comprises a plurality of the second demarcation parts parts, the first demarcation part has a line width that is greater than a line width of the second demarcation part.

2. The transparent antenna according to claim 1, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends along the first direction and the second demarcation part extends along the second direction, and the second side parts are each configured such that the first demarcation part extends along the second direction and the second demarcation part extends along the first direction.

3. The transparent antenna according to claim 1, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to incline with respect to the first and second directions and the second demarcation part extends along the second direction, and the second side parts are each configured such that the first demarcation part extends in such a form as to incline with respect to the first and second directions and the second demarcation part extends along the first direction.

4. The transparent antenna according to claim 1, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to intersect with the first direction and the second direction and is shaped curved and the second demarcation part extends along the second direction, and the second side parts are each configured such that the first demarcation part extends in such a form as to intersect with the first direction and the second direction and is shaped curved and the second demarcation part extends along the first direction.

5. The transparent antenna according to claim 1, wherein the antenna wire has a planar shape forming a quadrangular ring and has a pair of first side parts extending parallel to a first direction, a pair of second side parts extending parallel to a second direction orthogonal to the first direction, and corner parts connecting the first side parts and the second side parts, the first side parts and the second side parts each have the first extension part and the second extension part, the corner parts each have a corner-part first extension part extending parallel to the first direction and a corner-part second extension part extending parallel to the second direction, and the corner parts are each configured such that the corner-part first extension part and the corner-part second extension part are equal in per unit length area to each other.

6. The transparent antenna according to claim 5, wherein the corner parts are each configured such that the per unit length area of the corner-part first extension part is smaller than the per unit length area of the first extension part constituting the first side parts and the second side parts and the per unit length area of the corner-part second extension part is larger than the per unit length area of the second extension part constituting the first side parts and the second side parts.

7. The transparent antenna according to claim 1, further comprising a lead wiring part extending in such a form as to lead from the antenna wire, wherein the lead wiring part has a first lead extension part extending along a direction of extension of the lead wiring part and a second lead extension part extending along a direction intersecting with the direction of extension of the lead wiring part, and the lead wiring part is configured such that a per unit length area of the first lead extension part is larger than a per unit length area of the second lead extension part.

8. A transparent antenna-equipped display device comprising:

the transparent antenna;

wherein the transparent antenna has an antenna wire, formed by a reticulated metal film in a shape of a ring, which generates a magnetic field on a center side thereof, wherein the antenna wire has a fire extension part extending along an extending direction that the antenna wire extends and a second extension part extending along a direction intersecting with the extending direction, and the antenna wire is configured such that a per unit length area of the first extension part is larger than a per unit length area of the second extension part, a transparent antenna substrate provided with the transparent antenna; and a display panel, stacked on the transparent antenna substrate, which has a display region that is capable of displaying an image and a non-display region surrounding the display region, wherein the transparent antenna is placed in a position overlapping the display region.

9. The transparent antenna-equipped display device according to claim 8, wherein the display panel has a large number of pixels arranged in a matrix in a plane of a display surface of the display panel, the transparent antenna has a large number of reticulations arranged in a matrix, and a direction of arrangement of the reticulations is inclined with respect to a direction of arrangement of the pixels.

10. A transparent antenna comprising: an antenna wire, formed by a reticulated metal film in a shape of a ring, which generates a magnetic field on a center side thereof, wherein the antenna wire has a first extension part extending along an extending direction that antenna wire extends and a second extension part extending along a direction intersecting with the extending direction, and the antenna wire is configured such that a per unit length area of the first extension part is larger than a per unit length area of the second extension part, wherein the antenna wire has a plurality of reticulations and a plurality of demarcation parts demarcating the reticulations, the demarcation parts being each constituted by a first demarcation part extending along the extending direction and a second demarcation part extending along a direction intersecting with the extending direction, the first extension part comprises a plurality of the first demarcation parts, and the second extension part comprises a plurality of the second demarcation parts, wherein a spacing between adjacent ones of the first demarcation parts is narrower than a spacing between adjacent ones of the second demarcation parts.

11. The transparent antenna according to claim 10, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends along the first direction and the second demarcation part extends along the second direction, and the second side parts are each configured such that the first demarcation part extends along the second direction and the second demarcation part extends along the first direction.

12. The transparent antenna according to claim 10, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to incline with respect to the first and second directions and the second demarcation part extends along the second direction, and the second side parts are each configured such that the first demarcation part extends in such a form as to incline with respect to the first and second directions and the second demarcation part extends along the first direction.

13. The transparent antenna according to claim 10, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to intersect with the first direction and the second direction and is shaped curved and the second demarcation part extends along the second direction, and the second side parts are each configured such that the first demarcation part extends in such a form as to intersect with the first direction and the second direction and is shaped curved and the second demarcation part extends along the first direction.

14. The transparent antenna according to claim 10, wherein the antenna wire has a planar shape forming a quadrangular ring and has a pair of first side parts extending parallel to a first direction, a pair of second side parts extending parallel to a second direction orthogonal to the first direction, and corner parts connecting the first side parts and the second side parts, the first side parts and the second side parts each have the first extension part and the second extension part, the corner parts each have a corner-part first extension part extending parallel to the first direction and a corner-part second extension part extending parallel to the second direction, and the corner parts are each configured such that the corner-part first extension part and the corner-part second extension part are equal in per unit length area to each other.

15. The transparent antenna according to claim 14, wherein the corner parts are each configured such that the per unit length area of the corner-part first extension part is smaller than the per unit length area of the first extension part constituting the first side parts and the second side parts and the per unit length area of the corner-part second extension part is larger than the per unit length area of the second extension part constituting the first side parts and the second side parts.

16. The transparent antenna according to claim 10, further comprising a lead wiring part extending in such a form as to lead from the antenna wire, wherein the lead wiring part has a first lead extension part extending along a direction of extension of the lead wiring part and a second lead extension part extending along a direction intersecting with the direction of extension of the lead wiring part, and the lead wiring part is configured such that a per unit length area of the first lead extension part is larger than a per unit length area of the second lead extension part.

17. A transparent antenna comprising: an antenna wire, formed by a reticulated metal film in a shape of a ring, which generates a magnetic field on a center side thereof, wherein the antenna wire has a first extension part extending along an extending direction that antenna wire extends and a second extension part extending along a direction intersecting with the extending direction, and the antenna wire is configured such that a per unit length area of the first extension part is larger than a per unit length area of the second extension part, wherein the antenna wire has a plurality of reticulations and a plurality of demarcation parts demarcating the reticulations, the demarcation parts being each constituted by a first demarcation part extending along the extending direction and a second demarcation part extending along a direction intersecting with the extending direction, the first extension part comprises a plurality of the first demarcation parts, and the second extension part comprises a plurality of the second demarcation parts, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends along the first direction and the second demarcation part extends along the second direction, and the second side parts are each configured such that the first demarcation part extends along the second direction and the second demarcation part extends along the first direction.

18. A transparent antenna comprising: an antenna wire, formed by a reticulated metal film in a shape of a ring, which generates a magnetic field on a center side thereof, wherein the antenna wire has a first extension part extending along an extending direction that antenna wire extends and a second extension part extending along a direction intersecting with the extending direction, and the antenna wire is configured such that a per unit length area of the first extension part is larger than a per unit length area of the second extension part, wherein the antenna wire has a plurality of reticulations and a plurality of demarcation parts demarcating the reticulations, the demarcation parts being each constituted by a first demarcation part extending along the extending direction and a second demarcation part extending along a direction intersecting with the extending direction, the first extension part comprises a plurality of the first demarcation parts, and the second extension part comprises a plurality of the second demarcation parts, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to incline with respect to the first and second directions and the second demarcation part extends along the second direction, and the second side parts are each configured such that the first demarcation part extends in such a form as to incline with respect to the first and second directions and the second demarcation part extends along the first direction.

19. A transparent antenna comprising: an antenna wire, formed by a reticulated metal film in a shape of a ring, which generates a magnetic field on a center side thereof, wherein the antenna wire has a first extension part extending along an extending direction that antenna wire extends and a second extension part extending along a direction intersecting with the extending direction, and the antenna wire is configured such that a per unit length area of the first extension part is larger than a per unit length area of the second extension part, wherein the antenna wire has a plurality of reticulations and a plurality of demarcation parts demarcating the reticulations, the demarcation parts being each constituted by a first demarcation part extending along the extending direction and a second demarcation part extending along a direction intersecting with the extending direction, the first extension part comprises a plurality of the first demarcation parts, and the second extension part comprises a plurality of the second demarcation parts, wherein the antenna wire has a planar shape forming a quadrangular ring and has a pair of first side parts extending parallel to a first direction and a pair of second side parts extending parallel to a second direction orthogonal to the first direction, the first side parts are each configured such that the first demarcation part extends in such a form as to intersect with the first direction and the second direction and is shaped curved and the second demarcation part extends along the second direction, and the second side parts are each configured such that the first demarcation part extends in such a form as to intersect with the first direction and the second direction and is shaped curved and the second demarcation part extends along the first direction.

20. A transparent antenna comprising: an antenna wire, formed by a reticulated metal film in a shape of a ring, which generates a magnetic field on a center side thereof, wherein the antenna wire has a first extension part extending along an extending direction that antenna wire extends and a second extension part extending along a direction intersecting with the extending direction, and the antenna wire is configured such that a per unit length area of the first extension part is larger than a per unit length area of the second extension part, wherein the antenna wire has a planar shape forming a quadrangular ring and has a pair of first side parts extending parallel to a first direction, a pair of second side parts extending parallel to a second direction orthogonal to the first direction, and corner parts connecting the first side parts and the second side parts, the first side parts and the second side parts each have the first extension part and the second extension part, the corner parts each have a corner-part first extension part extending parallel to the first direction and a corner-part second extension part extending parallel to the second direction, and the corner parts are each configured such that the corner-part first extension part and the corner-part second extension part are equal in per unit length area to each other, wherein the corner parts are each configured such that the per unit length area of the corner-part first extension part is smaller than the per unit length area of the first extension part constituting the first side parts and the second side parts and the per unit length area of the corner-part second extension part is larger than the per unit length area of the second extension part constituting the first side parts and the second side parts.

* * * * *